US007166003B2

(12) United States Patent
Motose

(10) Patent No.: US 7,166,003 B2
(45) Date of Patent: Jan. 23, 2007

(54) ENGINE CONTROL ARRANGEMENT FOR WATERCRAFT

(75) Inventor: Hitoshi Motose, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/872,013

(22) Filed: Jun. 18, 2004

(65) Prior Publication Data

US 2005/0085141 A1 Apr. 21, 2005

(30) Foreign Application Priority Data

Jun. 18, 2003 (JP) ..... 2003-173809

(51) Int. Cl.
*B63H 21/22* (2006.01)

(52) U.S. Cl. ..... 440/1; 440/87

(58) Field of Classification Search ..... 440/1, 440/87

See application file for complete search history.

(56) References Cited

U.S. PATENT DOCUMENTS

| | | | | |
|---|---|---|---|---|
| 4,556,005 | A | 12/1985 | Jackson | |
| 4,949,662 | A | 8/1990 | Kobayashi | |
| 4,961,396 | A | 10/1990 | Sasagawa | |
| 4,971,584 | A | 11/1990 | Inoue et al. | |
| 4,972,792 | A | 11/1990 | Yokoyama et al. | |
| 4,989,533 | A | 2/1991 | Horiuchi | |
| 5,094,182 | A | 3/1992 | Simner | |
| 5,113,777 | A | 5/1992 | Kobayashi | |
| 5,167,547 | A | 12/1992 | Kobayashi et al. | |
| 5,244,425 | A | 9/1993 | Tasaki et al. | |
| 5,350,325 | A | 9/1994 | Nanami | |
| 5,367,970 | A | 11/1994 | Beauchamp et al. | |
| 5,429,533 | A | 7/1995 | Kobayashi et al. | |
| 5,474,007 | A | 12/1995 | Kobayashi | |
| 5,520,133 | A | 5/1996 | Wiegert | |
| 5,538,449 | A * | 7/1996 | Richard | 440/1 |
| 5,591,057 | A | 1/1997 | Dai et al. | |
| 5,603,644 | A | 2/1997 | Kobayashi et al. | |
| 5,697,317 | A | 12/1997 | Pereira | |
| 5,707,264 | A | 1/1998 | Kobayashi et al. | |
| 5,713,297 | A | 2/1998 | Tani et al. | |
| 5,839,700 | A | 11/1998 | Nedderman, Jr. | |
| 5,908,006 | A | 6/1999 | Ibata | |

(Continued)

FOREIGN PATENT DOCUMENTS

CA 2271332 2/2000

(Continued)

OTHER PUBLICATIONS

Co-pending U.S. Pat. Appl. No. 11/083,290, filed Mar. 17, 2005. Title: Engine Control Device. Inventor: Ishida et al.

(Continued)

*Primary Examiner*—Stephen Avila
(74) *Attorney, Agent, or Firm*—Knobbe, Martens, Olson & Bear, LLP

(57) ABSTRACT

A control system for watercraft includes a mode switch allowing the watercraft to be operated in a number of different modes. The modes selectable by the rider can include a normal mode, a reduced output mode, a suppressed acceleration mode, an enhanced acceleration mode, and a steering mode, as well as other modes.

14 Claims, 16 Drawing Sheets

U.S. PATENT DOCUMENTS

| | | | | |
|---|---|---|---|---|
| 5,988,091 | A | 11/1999 | Willis | |
| 6,032,605 | A | 3/2000 | Takashima | |
| 6,038,995 | A | 3/2000 | Karafiath et al. | |
| 6,062,154 | A | 5/2000 | Ito | |
| 6,086,437 | A | 7/2000 | Murray | |
| 6,138,601 | A | 10/2000 | Anderson et al. | |
| 6,159,059 | A | 12/2000 | Bernier et al. | |
| 6,171,159 | B1 | 1/2001 | Shen et al. | |
| 6,174,210 | B1 | 1/2001 | Spade et al. | |
| 6,178,907 | B1 | 1/2001 | Shirah et al. | |
| 6,202,584 | B1 | 3/2001 | Madachi et al. | |
| 6,213,044 | B1 | 4/2001 | Rodgers et al. | |
| 6,216,624 | B1 | 4/2001 | Page | |
| 6,227,919 | B1 | 5/2001 | Blanchard | |
| 6,244,914 | B1 | 6/2001 | Freitag et al. | |
| 6,305,307 | B1 | 10/2001 | Yokoya | |
| 6,314,900 | B1 | 11/2001 | Samuelsen | |
| 6,332,816 | B1 | 12/2001 | Tsuchiya et al. | |
| 6,336,834 | B1 | 1/2002 | Nedderman, Jr. et al. | |
| 6,386,930 | B1 | 5/2002 | Moffet | |
| 6,415,729 | B1 | 7/2002 | Nedderman, Jr. et al. | |
| 6,428,372 | B1 | 8/2002 | Belt | |
| 6,443,785 | B1 | 9/2002 | Swartz et al. | |
| 6,478,638 | B1 | 11/2002 | Matsuda et al. | |
| 6,511,354 | B1 * | 1/2003 | Gonring et al. | 440/87 |
| 6,523,489 | B1 | 2/2003 | Simard et al. | |
| 6,530,812 | B1 | 3/2003 | Koyano et al. | |
| 6,668,796 | B1 | 12/2003 | Umemoto et al. | |
| 6,695,657 | B1 | 2/2004 | Hattori | |
| 6,709,302 | B1 | 3/2004 | Yanagihara | |
| 6,709,303 | B1 | 3/2004 | Umemoto et al. | |
| 6,722,932 | B1 | 4/2004 | Yanagihara | |
| 6,733,350 | B1 | 5/2004 | Iida et al. | |
| 6,827,031 | B1 | 12/2004 | Aoyama | |
| 6,855,014 | B1 | 2/2005 | Kinoshita et al. | |
| 2003/0000500 | A1 * | 1/2003 | Chatfield | 123/438 |
| 2004/0067700 | A1 | 4/2004 | Kinoshita et al. | |
| 2004/0069271 | A1 | 4/2004 | Kanno et al. | |
| 2004/0147179 | A1 | 7/2004 | Mizuno et al. | |
| 2005/0263132 | A1 | 12/2005 | Yanagihara | |
| 2005/0273224 | A1 | 12/2005 | Ito et al. | |
| 2005/0287886 | A1 | 12/2005 | Ito et al. | |
| 2006/0004502 | A1 | 1/2006 | Kaneko et al. | |
| 2006/0037522 | A1 | 2/2006 | Kaneko et al. | |

FOREIGN PATENT DOCUMENTS

| | | |
|---|---|---|
| JP | 2001-329881 | 11/2001 |
| WO | WO 00/40462 | 7/2000 |

OTHER PUBLICATIONS

Co-pending U.S. Pat. Appl. No. 11/335,996, filed Jan. 20, 2006. Title: Operation Control System for Small Boat. Inventor: Kinoshita et al.

Co-pending U.S. Pat. Appl. No. 11/336,711, filed Jan. 20, 2006. Title: Operation Control System for Planing Boat. Inventor: Kinoshita et al.

Advertisement for trim adjuster for Sea-Doo watercraft - Personal Watercraft Illustrated, Aug. 1998.

Advertisement for trim adjuster - Jet Sports, Aug. 1997.

Advertisement for Fit and Trim and Fit and Trim II - Jet Sports. Aug. 1996.

* cited by examiner

ENGINE CONTROL ARRANGEMENT FOR WATERCRAFT

PRIORITY INFORMATION

This application is based on and claims priority to Japanese Patent Application No. 2003-173809, filed Jun. 18, 2003, the entire contents of which is hereby expressly incorporated by reference.

BACKGROUND OF THE INFORMATIONS

1. Field of the Inventions

The present application generally relates to an engine control arrangement for controlling a watercraft, and more particularly relates to an engine management system that provides options for watercraft engine operation.

2. Description of the Related Art

Watercraft, including personal watercraft and jet boats, are often powered by an internal combustion engine having an output shaft arranged to drive a water propulsion device. These types of watercraft often include handlebars that are manipulated by a rider of the watercraft to effect steering. Typically, the handlebars carry a number of controls, including but without limitation, a finger or thumb-operated lever for controlling the power output of the engine.

Typically, the areas in the vicinity of marinas, docks, beaches, and boat ramps are controlled environments in which the maximum speed limit for all watercraft operating in such areas is limited to about five miles per hour. This is to limit the noise and wake generated by the watercraft operating in these areas. When a rider operates such a watercraft in a reduced speed area for long periods of time, the rider's hand, fingers, or thumb can become fatigued through the prolonged manipulation of the engine power control lever.

SUMMARY OF THE INVENTIONS

An embodiment of at least one of the inventions disclosed herein includes a watercraft comprising a hull, an engine supported by the hull, and a propulsion device supported by the hull and driven by the engine so as to propel the watercraft. A power output control module is configured to control a power output of the engine in at least three different modes of operation. The at least three modes of operation include at least three of a normal operation mode, a reduced output mode, an enhanced acceleration mode, a suppressed acceleration mode, and a steering dependent mode, and a mode selector configured to be operable by an operator of the watercraft so as to allow the operator to select one of the least three modes of operation.

Another embodiment of at least one of the invention disclosed herein is directed to a method of controlling an engine of the watercraft having an engine driving a propulsion device, a throttle valve configured to meter an amount of air flowing into the engine, and a power output request device configured to be operable by a rider of the watercraft. The method comprises changing the opening of the throttle valve in accordance with a first relationship with a state of the power output request device under a first mode of operation, changing the opening of the throttle valve in accordance with a second relationship with a state of the power output request device under a second mode of operation, and changing the opening of the throttle out in accordance with a third relationship with a state of the power output request device under a third mode of operation. The first, second, and third modes of operation correspond respectively to at least one of a normal mode, an output suppression mode, an acceleration suppression mode, an enhanced acceleration mode, and a steering dependent mode.

Another embodiment of at least one of the invention disclosed herein is directed to a watercraft comprising a hull, an engine supported by the hull, a propulsion device supported by the hull and driven by the engine. A throttle lever is arranged to be manipulable by an operator of the watercraft. A throttle valve is configured to meter an amount of air flowing into the engine. A mode selector is positioned so as to be manipulable by an operator of the watercraft, the mode selector being configured to allow an operator to select one of the least three modes of operation. A power output control module includes means for controlling the position of the throttle valve based on a position of the throttle lever in accordance with the at least three modes of operation, each of which define a different relationship between the position of the throttle lever and the position of the throttle valve.

BRIEF DESCRIPTION OF THE DRAWINGS

These and other aspects of the present inventions are described in detail below with reference to the accompanying drawings. The drawings comprise 17 figures.

DETAILED DESCRIPTION OF THE PREFERRED EMBODIMENTS

Figure 1:
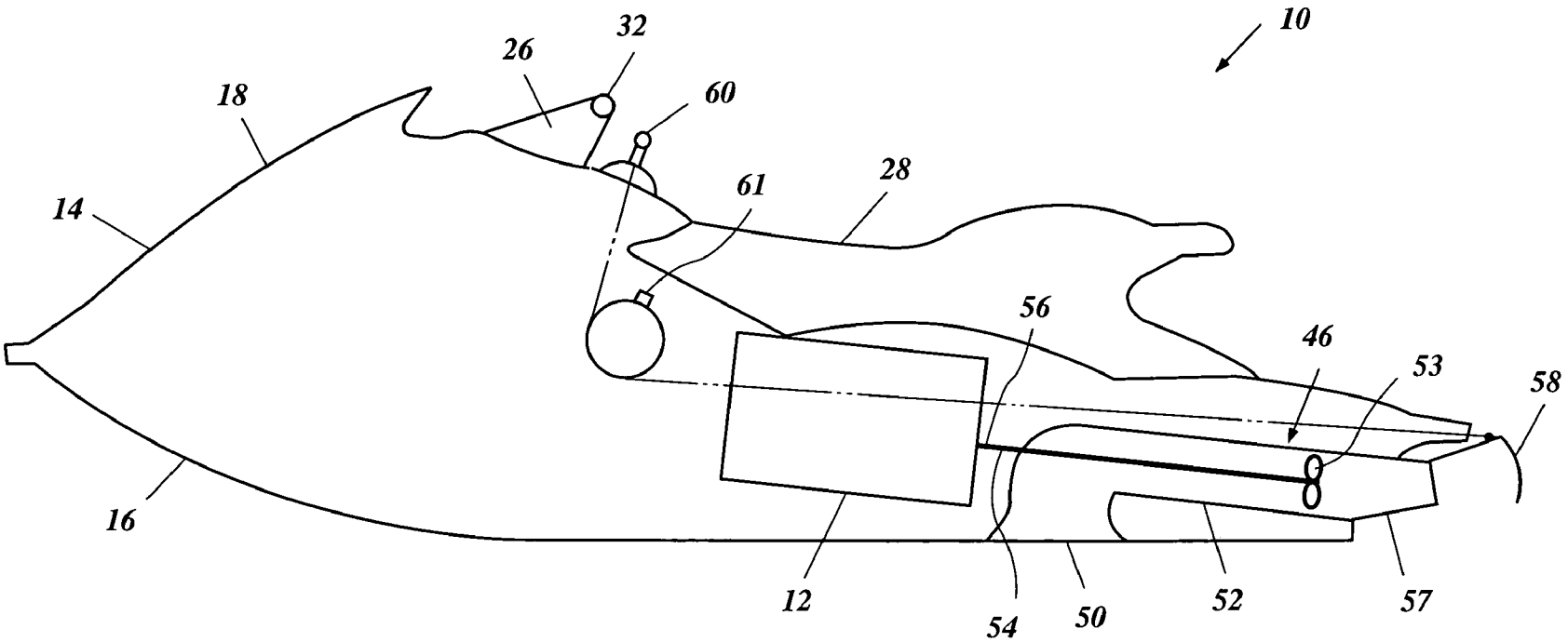
FIG. 1 is a side elevational view of a personal watercraft of the type powered by an engine controlled in accordance with a preferred embodiment.
Figure 2:
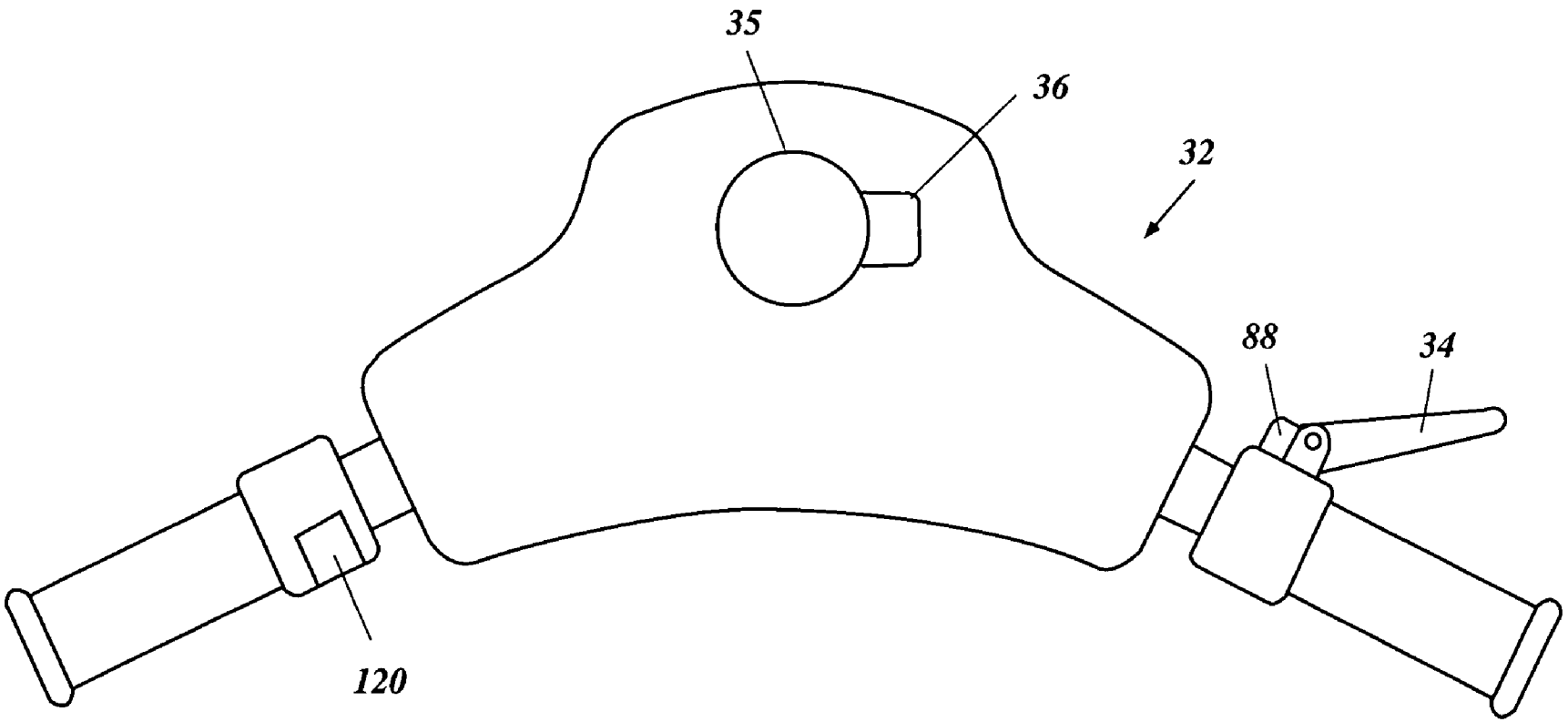
FIG. 2 is a top plan view of a handlebar steering assembly including a steering sensor as well as a throttle lever and a throttle lever position sensor.
Figure 3:
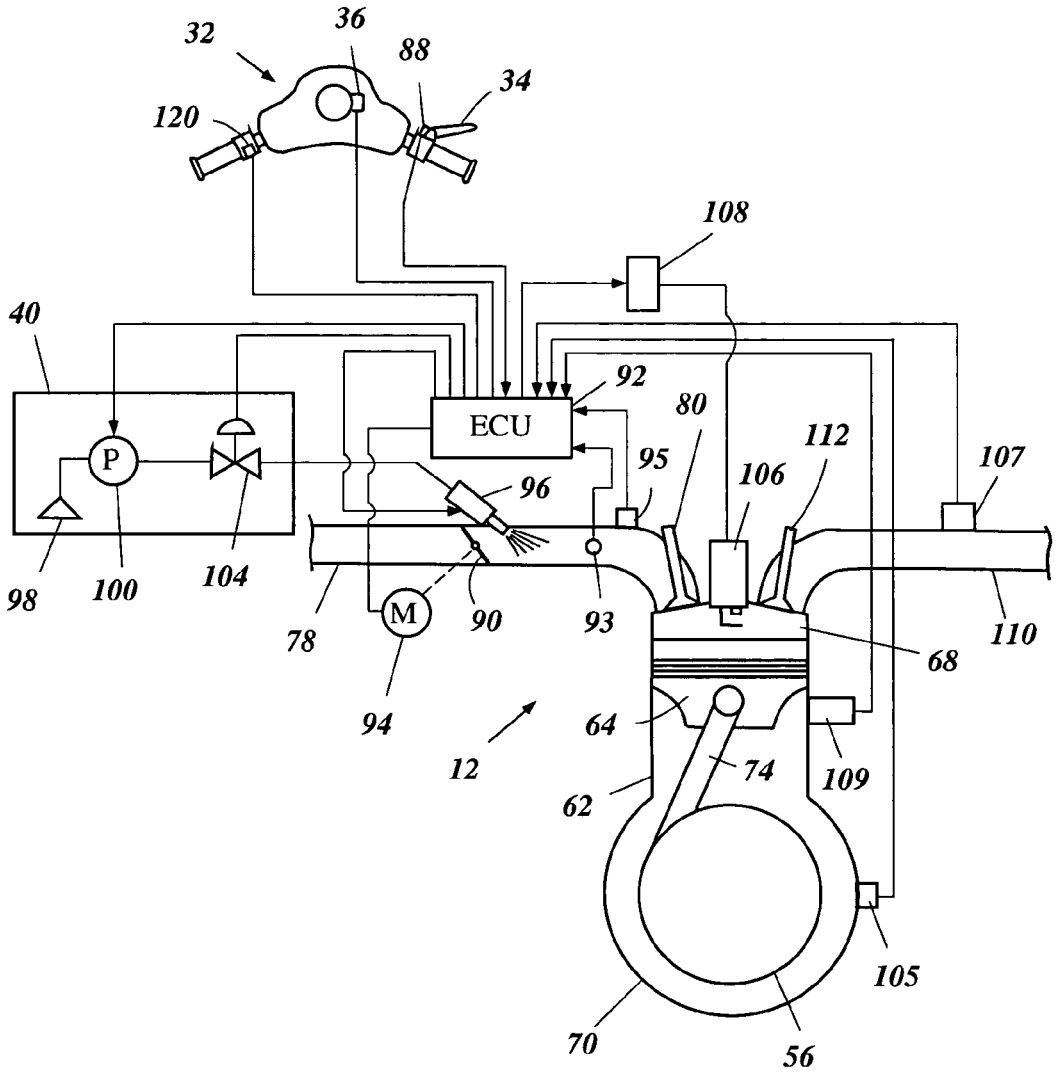
FIG. 3 is a schematic view showing the engine control system, including at least a portion of the engine in cross-section, an ECU, and a simplified fuel injection and simplified steering system.

With reference to FIGS. 1–3, an overall configuration of an engine control system is described below in the environment of a personal watercraft 10. The watercraft 10 includes an engine 12 operated by the control system. The control system described below has particular utility for use with personal watercraft, and thus, the control system is described in the environment of the personal watercraft 10. However, the control system can be used with other types of vehicles, such as, for example, small jet boats and other vehicles.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity.

A control mast 26 extends upwardly to support a handlebar 32. The handlebar 32 is provided primarily for controlling the direction of the watercraft 10. The handlebar 32 preferably carries other mechanisms, such as, for example, a throttle lever 34 that is used to control the engine output (i.e., to vary the engine speed). The handlebar 32 rotates about a steering shaft 35 that allows the handlebar 32 to rotate left or right within a predetermined steering angle. A portion of the steering shaft 35 can be mounted relative to the hull 14 with at least one bearing so as to allow the shaft to rotate relative to the hull.

The shaft 35 can also be formed in sections that are configured to articulate relative to one another. For example, the shaft sections can be configured for a tilt steering mechanism allowing an angle of inclination of a upper portion of the shaft to be adjustable while a lower section of the shaft 35 remains at a fixed angle of inclination. In some embodiments, the sections can be connected through what is commonly referred to as a "universal joint". However, other types of tilt steering mechanisms can also be used.

A steering sensor 36 can be configured to determine an angle at which the handlebar 32 is turned. For example, the sensor 36 can be in the form of a simple proximity switch configured to detect when a finger extending from a portion of the steering shaft 35 is in proximity of the sensor 36. As such, the sensor 36 can be arranged to detect the finger when the handle bar 32 is turned to a predetermine position toward the port and/or starboard directions. Other sensors can also be used to determine the precise angle at which the handlebar 32 may be turned.

In some embodiments the sensor 36 can be configured to determine the amount of steering torque applied to the handlebar 32. For example, but without limitation, the steering torque sensor 36 can be configured to detect a magnitude of a force applied to the handlebar 32 when the handlebar 32 is turned past a predetermined handlebar angle. The steering torque sensor 36 can be constructed in any known manner. In one exemplary but non-limiting embodiment, the torque sensor 36 can be configured to work in conjunction with stoppers commonly used on watercraft steering mechanisms to define the maximum turning positions.

For example, as noted above, the handlebar 32 rotates about a steering shaft 35. In at least one embodiment, the steering shaft can include a finger member rigidly attached to the shaft and extending radially outwardly relative to the steering shaft 35. One or a plurality of stoppers can be used to define the maximum angular positions of the handlebar 32. For example, the stopper or stoppers can be mounted in the vicinity of the finger member such that when the handlebar 32 is turned, thereby causing the finger member to rotate along with the shaft, the finger member eventually contacts left and right maximum position surfaces defined by the stopper(s). In one exemplary but non-limiting embodiment, the stopper(s) can be disposed such that the handlebar 32 can rotate about 15–25 degrees in either direction before contacting the stopper(s).

As noted above, the torque sensor 36 can be configured to work in conjunction with the stoppers and finger member. For example, pressure sensors can be provided on each of the maximum position surfaces defined by the stopper(s). These pressure sensors can be connected to an Electronic Control Unit (ECU) 92 described below, so as to provide the ECU 92 with signals representing a force at which the handlebar 32, and thus the finger member, is pressed against the stopper(s). In some embodiments, at least one pressure sensor can be mounted on the finger member. Such a sensor can be in a form commonly referred to as a "load cell". Thus, when this sensor is pressed against the stopper(s), signals can be sent to the ECU 92 indicative of the steering force applied to the handlebar 32. In some embodiments, the pressure sensor(s), regardless of weather they are mounted to the finger member or the stopper(s), can be mounted with or be incorporated into a spring, and thereby allow some additional rotation of the handlebar 32 after the stopper is initially contacted. In another exemplary, but non-limiting embodiment, the stopper(s) and sensor(s) can be mounted such that initial contact occurs when the handlebar 32 is turned about 19 degrees from a center position. As used herein, the term "initial contact" merely referees to when the pressure sensor(s) is first contacted by a stopper or the finger member, such that the sensor(s) is pressed between the finger member and the corresponding stopper member.

As additional steering force is applied to the handlebar 32, the pressure sensor and/or an associated spring can deflect, allowing the handlebar 32 to be turned an additional amount. Additionally, the signal emitted from the steering sensor 36 changes so as to indicate an increasing steering force as the force applied to the handlebar 32 is increased. Regardless of the particular arrangement used for generating the steering force signal, the use of a steering force sensor provides additional advantages in providing a more comfortable riding experience, described in greater detail below.

A seat 28 is disposed atop a pedestal. In the illustrated arrangement, the seat 28 has a saddle shape. Hence, a rider can sit on the seat 28 in a straddle fashion and thus, the illustrated seat 28 often is referred to as a straddle-type seat.

A fuel tank 40 (FIG. 3) is positioned in the cavity under the bow portion of the upper hull section 18 in the illustrated arrangement. A duct (not shown) preferably couples the fuel tank 40 with a fuel inlet port positioned at a top surface of the bow of the upper hull section 18. A closure cap closes the fuel inlet port to inhibit water infiltration.

The engine 12 is disposed in an engine compartment. The engine compartment preferably is located under the seat 28, but other locations are also possible (e.g., beneath the control mast 26 or in the bow). The rider thus can access the engine 12 in the illustrated arrangement through an access opening by detaching the seat 28. In general, the engine compartment can be defined by a forward and rearward bulkhead. Other configurations, however, are also possible.

A jet pump unit 46 propels the illustrated watercraft 10. Other types of marine drives can be used depending upon the application. The jet pump unit 46 preferably is disposed within a tunnel formed on the underside of the lower hull section 16. The tunnel has a downward facing inlet port 50 opening toward the body of water. A jet pump housing 52 is disposed within a portion of the tunnel. Preferably, an impeller 53 is supported within the housing 52.

An impeller shaft 54 extends forwardly from the impeller and is coupled with a crankshaft 56 of the engine 12 by a suitable coupling member (not shown). The crankshaft of the engine 12 thus drives the impeller shaft 54. The rear end of the housing 52 defines a discharge nozzle 57. A steering nozzle (not shown) is affixed proximate the discharge nozzle 57. The nozzle can be pivotally moved about a generally vertical steering axis. The steering nozzle is connected to the handle bar 32 by a cable or other suitable arrangement so that the rider can pivot the nozzle for steering the watercraft.

A reverse bucket mechanism 58 can advantageously at least partially cover the discharge nozzle 57 allowing at least some of the water that is discharged from the discharge nozzle 57 to flow towards the front of the watercraft 10. This flow of water towards the front of the watercraft 10 moves the watercraft in the reverse direction. A reverse lever 60 that activates the reverse bucket mechanism 58 is located in the vicinity of the control mast 26. A reverse switch 61 is positioned between the reverse lever 60 and the reverse bucket mechanism 58. The reverse switch 61 is activated whenever the reverse bucket mechanism 58 is placed in a position that allows the watercraft 10 to travel in the reverse direction.

With reference to FIG. 3, the engine 12 according to one preferred embodiment as illustrated in FIG. 3 operates on a four-stroke cycle combustion principal. The engine 12 includes a cylinder block 62 with four cylinder bores 65 formed side by side along a single plane. The engine 12 is an inclined L4 (in-line four cylinder) type. The engine illustrated in FIG. 4, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Other variations or types of engines on which various aspects and features of the present inventions can be used are described in detail below.

With continued reference to FIG. 3, a piston 64 reciprocates in each of the cylinder bores 65 formed within the cylinder block 62. A cylinder head member 66 is affixed to the upper end of the cylinder block 62 to close respective upper ends of the cylinder bores 65. The cylinder head member 66, the cylinder bores 65 and the pistons 64 together define combustion chambers 68.

A lower cylinder block member or crankcase member 70 is affixed to the lower end of the cylinder block 62 to close the respective lower ends of the cylinder bores 65 and to define, in part, a crankshaft chamber. The crankshaft 56 is journaled between the cylinder block 62 and the lower cylinder block member 70. The crankshaft 56 is rotatably connected to the pistons 64 through connecting rods 74. Preferably, a crankshaft speed sensor 105 is disposed proximate the crankshaft to output a signal indicative of engine speed. In some configurations, the crankshaft speed sensor 105 is formed, at least in part, with a flywheel magneto. The speed sensor 105 also can output crankshaft position signals in some arrangements.

The cylinder block 62, the cylinder head member 66 and the crankcase member 70 together generally define the engine 12. The engine 12 preferably is made of an aluminum based alloy. In the illustrated embodiment, the engine 12 is oriented in the engine compartment to position the crankshaft 56 generally parallel to a central plane. Other orientations of the engine, of course, are also possible (e.g., with a transversely or vertically oriented crankshaft).

The engine 12 preferably includes an air induction system to introduce air to the combustion chambers 68. In the illustrated embodiment, the air induction system includes four air intake ports 78 defined within the cylinder head member 66, which ports 78 generally correspond to and communicate with the four combustion chambers,68. Other numbers of ports can be used depending upon the application. Intake valves 80 are provided to open and close the intake ports 78 such that flow through the ports 78 can be controlled.

The air induction system also includes an air intake box (not shown) for smoothing intake airflow and acting as an intake silencer. The intake box is generally rectangular and defines a plenum chamber (not shown). Other shapes of the intake box of course are possible, but the plenum chamber preferably is as large as possible while still allowing for positioning within the space provided in the engine compartment.

A throttle lever position sensor 88 preferably is arranged proximate the throttle lever 34 in the illustrated arrangement. The sensor 88 preferably generates a signal that is representative of absolute throttle lever position. The signal from the throttle lever position sensor 88 preferably corresponds generally to an operator's torque request, as may be indicated by the degree of throttle lever position. However, the signal from the sensor 88 can also be considered as a watercraft speed request, an engine speed request, and/or a power request. As used herein, the term "output request" is intended to be generic to torque request, watercraft speed request, engine speed request, and power request. Additionally, the terms output request, torque request, watercraft speed request, engine speed request, and power request, are used herein interchangeably.

The air induction system also includes a throttle valve 90 disposed therein so as to meter or control an amount of air flowing into the intake port 78. In FIG. 3, the throttle valve 90 is illustrated as being within the intake port 78. This is merely a schematic illustration. In practice, the throttle valve 90 is typically disposed upstream from the intake port 78 in another portion of the induction system, such as, for example, but without limitation, at an upstream end of an intake runner and downstream from the plenum chamber, upstream from an intake air plenum, or other positions. In some embodiments, there can be one throttle valve 90 for each combustion chamber 68.

Additionally, in the illustrated embodiment, a throttle valve motor 94 is configured to provide for the movement of the throttle valve 90. For example, the throttle valve motor 94 can be any type of electric motor, including, for example, but without limitation, stepper motors, servo motors or any other type of known actuator. Depending on the type of actuator used, the motor 94 can be directly connected to a shaft upon which the throttle valve 90 is mounted or can be connected to the shaft or another part of the throttle valve 90 through one or a plurality of gear reduction sets.

The throttle valve motor 94 is connected to the ECU 92 so that the ECU 92 can control the operation of the motor 94. For example, the throttle motor 94 can be controlled by the ECU 92 to position the throttle valve 90 in accordance with the position of the throttle lever 34 as detected by the sensor 88. The ECU 92 can be configured to control the position of the throttle valve 90 in linear or non-linear relationships to the position of the throttle lever 34. As known in the art, such a non-linear relationship can provide a more proportional change in power or torque output of the engine 12 in response to a movement of the throttle lever 34. Additionally, the ECU 92 can be configured to control the throttle valve motor 94 in accordance with other strategies, some of which are described below in greater detail.

A manifold pressure sensor 93 and a manifold temperature sensor 95 can also be provided to determine engine load. The signal from the throttle lever position sensor 88 (and/or manifold pressure sensor 93) can be sent to the ECU 92 via a throttle position data line. The signal can be used to control various aspects of engine operation, such as, for example, but without limitation, fuel injection amount, fuel injection timing, ignition timing, ISC valve positioning and the like.

The engine 12 also includes a fuel injection system which preferably includes four fuel injectors 96, each having an injection nozzle exposed to a respective intake port 78 so that injected fuel is directed toward the respective combustion chamber 68. Thus, in the illustrated arrangement, the engine 12 features port fuel injection. It is anticipated that various features, aspects and advantages of the present inventions also can be used with direct or other types of indirect fuel injection systems.

With reference again to FIG. 3, fuel is drawn from the fuel tank 40 through a fuel filter 98 by a fuel pump 100, which is controlled by the ECU 92. The fuel is delivered to the fuel injectors 96 through a fuel delivery conduit. The pressure of the fuel delivered to the fuel in sectors 96 is controlled by a pressure control valve 104. The pressure control valve 104 is controlled by a signal from the ECU 92.

In operation, a predetermined amount of fuel is sprayed into the intake ports 78 via the injection nozzles of the fuel injectors 96. The timing and duration of the fuel injection is dictated by the ECU 92 based upon any desired control strategy. In one presently preferred configuration, the amount of fuel injected is determined based, at least in part, upon the sensed throttle lever position. The fuel charge delivered by the fuel injectors 96 then enters the combustion chambers 68 with an air charge when the intake valves 80 open the intake ports 78.

The engine 12 further includes an ignition system. In the illustrated arrangement, four spark plugs 106 are fixed on the cylinder head member 66. The electrodes of the spark plugs 106 are exposed within the respective combustion chambers 68. The spark plugs 106 ignite an air/fuel charge just prior to, or during, each power stroke. At least one ignition coil 108 delivers a high voltage to each spark plug 106. The ignition coil is preferably under the control of the ECU 92 to ignite the air/fuel charge in the combustion chambers 68.

The engine 12 further includes an exhaust system to discharge burnt charges, i.e., exhaust gases, from the combustion chambers 68. In the illustrated arrangement, the exhaust system includes four exhaust ports 110 that generally correspond to, and communicate with, the combustion chambers 68. The exhaust ports 110 preferably are defined in the cylinder head member 66. Exhaust valves 112 preferably are provided to selectively open and close the exhaust ports 110.

A combustion condition or oxygen sensor 107 preferably is provided to detect the in-cylinder combustion conditions by sensing the residual amount of oxygen in the combustion products at a point in time close to when the exhaust port is opened. The signal from the oxygen sensor 107 preferably is delivered to the ECU 92. The oxygen sensor 107 can be disposed within the exhaust system at any suitable location. In the illustrated arrangement, the oxygen sensor 107 is disposed proximate the exhaust port 110 of a single cylinder. Of course, in some arrangements, the oxygen sensor can be positioned in a location further downstream; however, it is believed that more accurate readings result from positioning the oxygen sensor upstream of a merge location that combines the flow of several cylinders.

The engine 12 further includes a cooling system configured to circulate coolant into thermal communication with at least one component within the watercraft 10. The cooling system can be an open-loop type of cooling system that circulates water drawn from the body of water in which the watercraft 10 is operating through thermal communication with heat generating components of the watercraft 10 and the engine 12. Other types of cooling systems can be used in some applications. For instance, in some applications, a closed-loop type liquid cooling system can be used to cool lubricant and other components.

An engine coolant temperature sensor 109 preferably is positioned to sense the temperature of the coolant circulating through the engine. Of course, the sensor 109 could be used to detect the temperature in other regions of the cooling system; however, by sensing the temperature proximate the cylinders of the engine, the temperature of the combustion chamber and the closely positioned portions of the induction system is more accurately reflected.

The engine 12 preferably includes a lubrication system that delivers lubricant oil to engine portions for inhibiting frictional wear of such portions. In the illustrated embodiment of FIG. 4, a closed-loop type lubrication system is employed. An oil delivery pump is provided within a circulation loop to deliver the oil through an oil filter (not shown) to the engine portions that are to be lubricated, for example, but without limitation, the pistons 64 and the crankshaft bearings (not shown).

In order to determine appropriate engine operation control scenarios, the ECU 92 preferably uses these control maps and/or indices stored within the ECU 92 in combination with data collected from various input sensors. The ECU's various input sensors can include, but are not limited to, the throttle lever position sensor 88, the manifold pressure sensor 93, the intake temperature sensor 95, the engine coolant temperature sensor 109, the oxygen ($O_2$) sensor 107, and a crankshaft speed sensor 105. A steering torque sensor is also provided and is used for engine control in accordance with suitable control routines, which are discussed below. It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity defined in the hull 14. The air is then introduced into the plenum chamber defined by the intake box and drawn towards the throttle valve 90. The majority of the air in the plenum chamber is supplied to the combustion chambers 68. The throttle valve 90 regulates an amount of the air permitted to pass to the combustion chambers 68. The opening angle of the throttle valve 90, and thus, the airflow across the throttle valve 90, can be controlled by the ECU 92 according to various engine parameters and the torque request signal received from the throttle lever position sensor 88. The air flows into the combustion chambers 68 when the intake valves 80 open. At the same time, the fuel injectors 96 spray fuel into the intake ports 78 under the control of ECU. Air/fuel charges are thus formed and delivered to the combustion chambers 68.

The air/fuel charges are fired by the spark plugs 106 throughout the ignition coil 108 under the control of the ECU 92. The burnt charges, i.e., exhaust gases, are discharged to the body of water surrounding the watercraft 10 through the exhaust system.

The combustion of the air/fuel charges causes the pistons 64 to reciprocate and thus causes the crankshaft 56 to rotate. The crankshaft 56 drives the impeller shaft 54 and the impeller rotates in the hull tunnel 48. Water is thus drawn into the jet pump unit 46 through the inlet port 50 and then is discharged rearward through the discharge nozzle 57.

With continued reference to FIG. 3, in accordance with some embodiments, the watercraft 210 also includes a mode selection switch 120. In the illustrated embodiment, the mode selection switch 120 is disposed adjacent to one of the grips of the handlebar 32. The mode selection switch 120 is disposed next to the left hand side grip of the handlebar 32. However, this is merely one exemplary, but non-limiting, position in which the mode selection switch 120 can be mounted.

The mode selection switch 120 is connected to the ECU 92. Preferably, the mode selection switch is configured to allow an operator of the watercraft 10 to choose between a plurality of operation modes of the watercraft. For example, but without limitation, the mode selection switch 120 can be configured to allow an operator to switch between normal, output suppression, acceleration suppression, enhanced acceleration, and steering dependent operation modes. For example, the mode operation selector 120 can be in the form of, for example, but without limitation, a rotary knob, a sliding switch, or a pivoting member configured to be movable by at least one finger of an operator's hand so as to provide a mode switching signal to the ECU 92. Optionally, the mode selector 120 can be in the form of a simple button. In this embodiment, the ECU 92 can be configured to display the presently selected operation mode on an electronic display disposed in the vicinity of the handlebars 32 and allow a user to browse through the operation modes and select one by manipulation of the button. However, these are merely exemplary forms of the mode selector 120 and other types of selectors can also be used.

Figure 4:
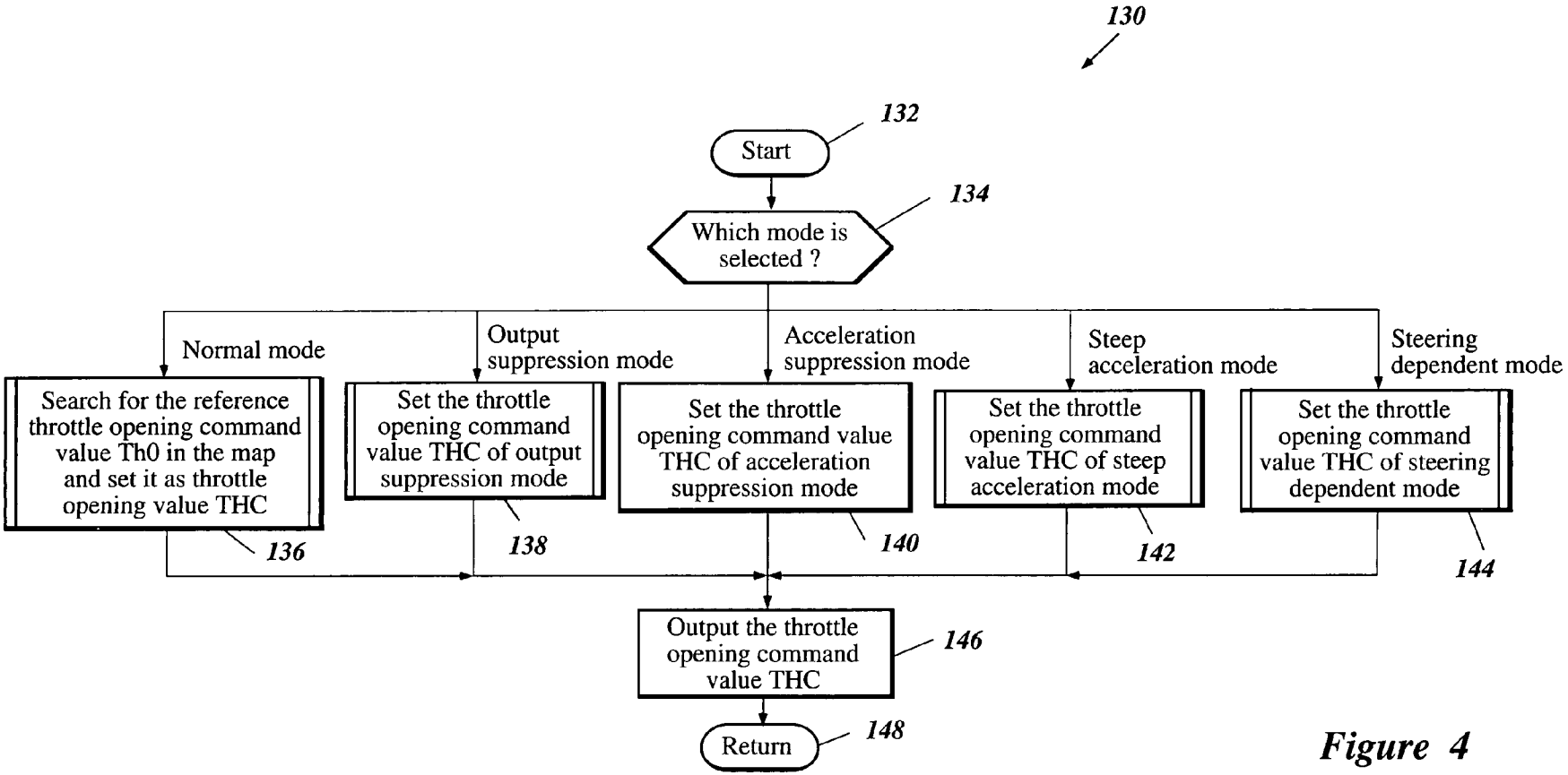
FIG. 4 is a flowchart illustrating a control routine that can be used with the control system illustrated in FIG. 3.

With reference to FIG. 4, a control routine 130 is illustrated therein and can be used in conjunction with the ECU 92 illustrated in FIG. 3. The control routine 130, in the illustrated embodiment, starts at an operation block 132. At the operation block 132, the control routine 130 is started. For example, the control routine 130 can be started when at least one of the following occur: a main power switch of the watercraft 10 is actuated, the engine 12 is started, or a lanyard is connected to the watercraft 10. As used herein, lanyard refers to a device which is typically connected to a rider of the watercraft and to a connector port on the watercraft. This type of lanyard is often used to shut off or deactivate the engine of a watercraft if a rider falls off. After the operation block 132, the control; routine 130 moves on to a decision block 134.

In the decision block 134, it is determined what operation mode is to be used for controlling the engine 12. As noted above, the mode selector 120 can be manipulated by a rider of the watercraft 10 to choose any one of a plurality of modes. After it is determined which operation mode is to be used for operating engine 12, the routine 130 moves on to the appropriate subroutine associated with the output mode.

In FIG. 4, the various operation modes are represented by subroutine or operation blocks as follows: block 136 represents normal mode operation, block 138 represents the output suppression mode, block 140 represents the acceleration suppression mode, block 142 represents the steep acceleration operation mode, and block 144 represents a steering dependent operation mode.

When the subroutine 130 reaches one of the subroutine blocks 136, 138, 140, 142, 144, as described in greater detail below, a throttle opening command value THC is determined based on the operator's torque request, watercraft speed request, power request, etc., which can be represented by the position of the throttle lever 34, as well as other parameters.

For example, during normal mode operation represented by the block 136, a throttle opening command value THC is determined so as to correspond to a position of a throttle valve 90 which would generate the power output from the engine 12 that corresponds to the position of the throttle lever 34. As noted above, the relationship between the position of the throttle valve 90 and the throttle lever 34 can be linear or non-linear. A non-linear relationship can be desirable because such can provide a more proportional power output from the engine, i.e., a power output from the engine 12 that is proportional to the position of the throttle lever 34. In some embodiments, the throttle command value determined in the subroutine 136 can provide a linear proportional relationship between the position of the throttle lever 34 and the position of the throttle valve 90.

Figure 5:
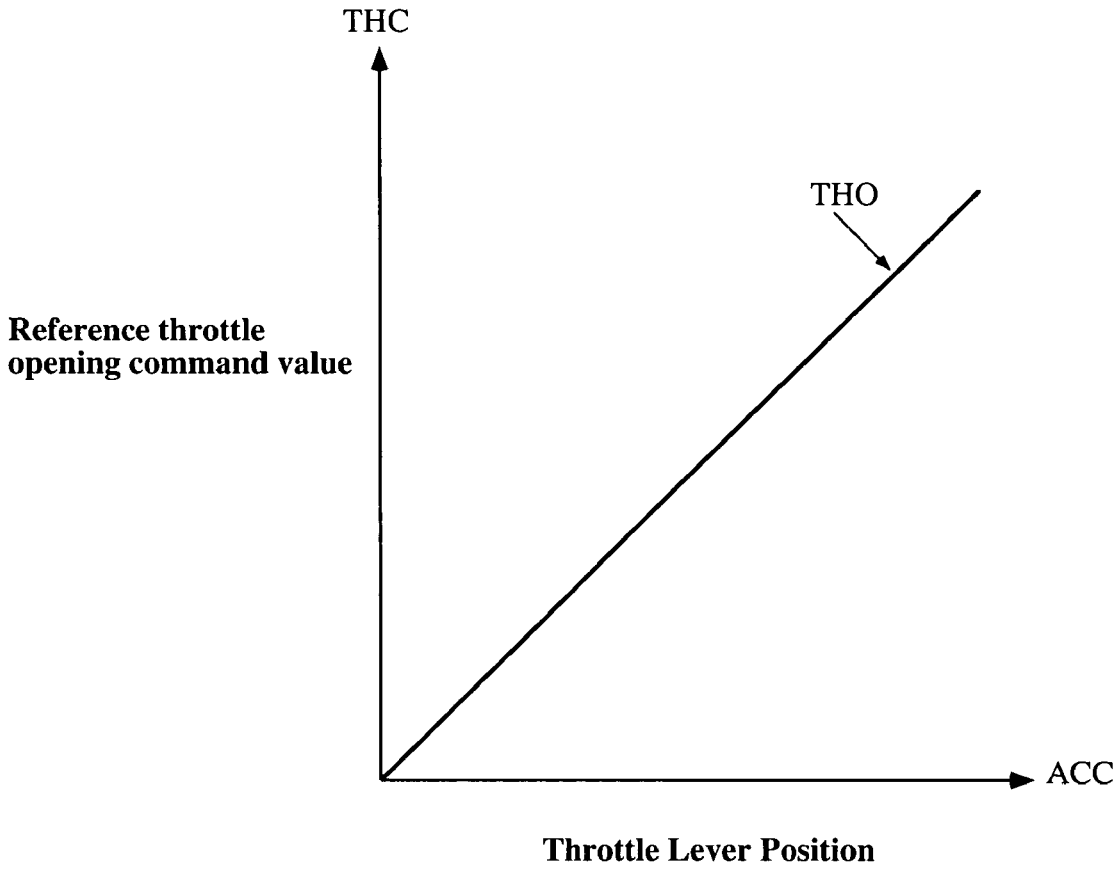
FIG. 5 is a graph illustrating an exemplary relationship between throttle lever position (horizontal axis) and a throttle opening command value (vertical axis) that can be used with the control routine illustrated in FIG. 4.

FIG. 5 illustrates an exemplary characteristic for determining a throttle opening command value THC to a throttle lever position ACC. The illustrated characteristic THO defines the relationship between the throttle opening command value THC to the throttle lever position ACC and can be stored as a data map within the watercraft 10 for use by the ECU 92.

After the throttle opening command value THC is determined, the control routine 130 moves on to an operation block 146. In the operation block 146, the control routine can output the throttle opening command value THC. For example, the routine 130 can cause the throttle opening command value THC determined in any one of the routines 136, 138, 140, 142, 144 for use in controlling the throttle valve motor 94. As such, the throttle valve motor 94 can manipulate the throttle valve 90 to achieve the opening corresponding to the throttle opening command value THC. In some embodiments, the routine 130 can simply cause the output of the throttle opening command value THC to another portion of the ECU 92 for use by the ECU 92 to control the motor 94. Of course, other module configurations are also possible.

After the operation block 146, the routine 130 moves to operation block 148 and repeats. Thus, as the routine 130 operates, the position of the mode selector 120 is repeatedly detected and thus, the determination of the throttle opening command value THC is calculated in accordance with the selected mode. In some embodiments, these processing operations are executed in accordance with a timer interrupt process at a predetermined sampling time. The predetermined sampling time can be set at any value. In an exemplary but non-limiting embodiment, the predetermined sampling time can be approximately every 10 milliseconds.

In this arrangement, the routine 130 can respond and quickly change modes when the position of the mode selector 120 has been changed.

Figure 6:
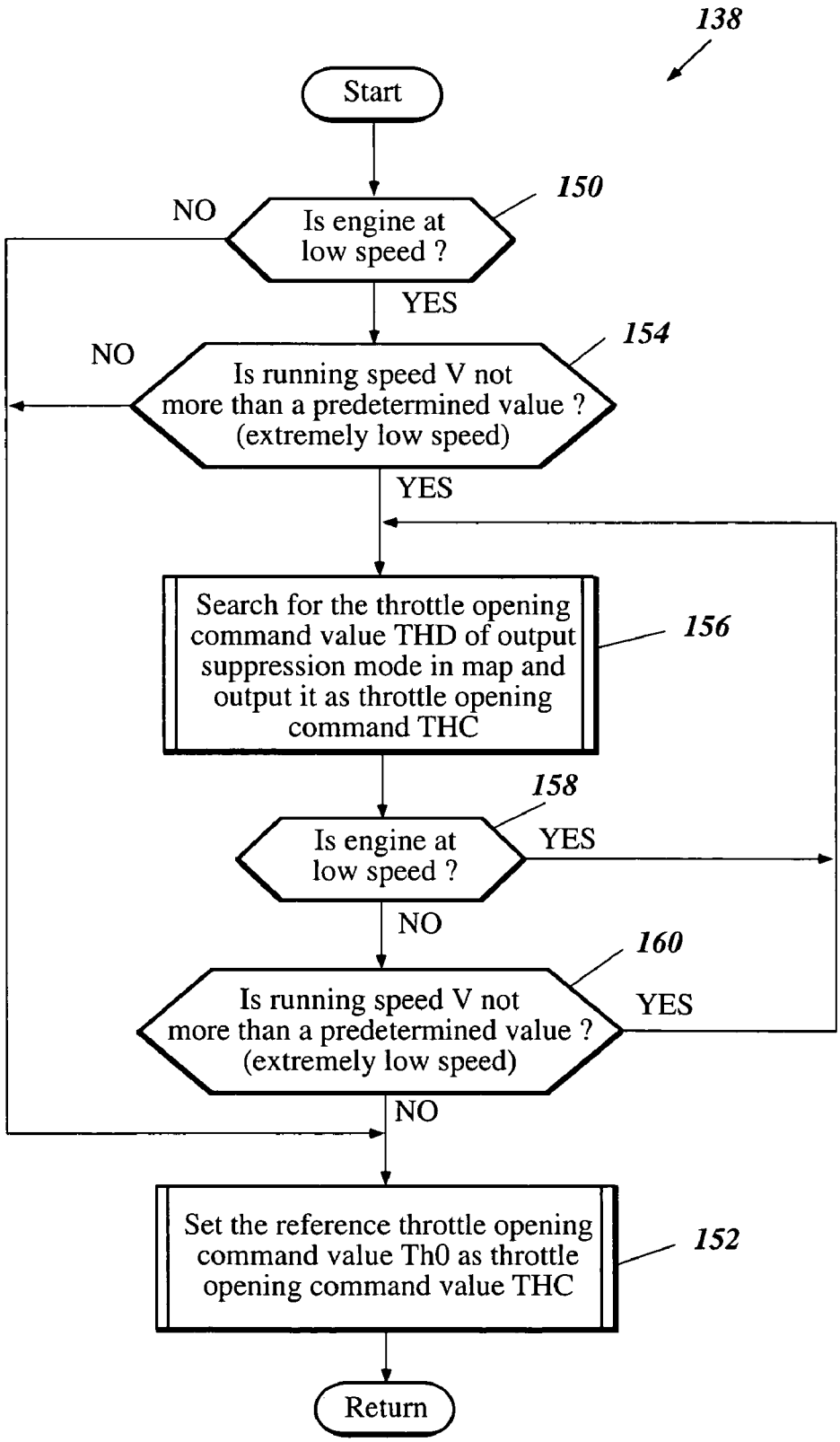
FIG. 6 is a flowchart illustrating a control routine that can be used in conjunction with the control system of FIG. 3.

With reference to FIG. 6, one optional embodiment of the routine 138 is illustrated therein, schematically represented by a flowchart. The routine 138 begins when the routine 130 when it is determined in the operation block 134 that the selected operation mode is the output suppression mode.

With reference to FIG. 6, the output suppression mode routine 138 begins at a decision block 150. In the decision block 150, it is determined whether the engine 12 is at a low speed operation. For example, the ECU 92 can determine from the engine speed sensor 105, the speed at which the engine 12 is operating. In an exemplary but non-limiting embodiment, the output of the sensor 105 can be compared to a predetermined value. Thus, if the value from the sensor 105 is below the predetermined value, it would be determined that the engine is at a low speed operation. If, in the decision block 150, it is determined that the engine is not at a low speed operation, the routine 138 moves on to operation block 152.

In the operation block 152, the throttle opening command value THC is set to the value TH0. For example, the value TH0 can be determined from the control map illustrated in FIG. 5. In this situation, where the engine speed is not in a low speed range, the throttle valve is controlled in accordance with a normal operation mode. After the operation block 152, the routine 138 returns to the start and repeats.

Returning to decision block 150, if it is determined that the engine speed is in a low speed operation range, the routine 138 moves on to a decision block 154. In the decision block 154, it is determined whether the watercraft speed V or "running speed" of the watercraft 10 is less than a predetermined speed. For example, it can be determined whether the speed V of the watercraft 10 is in an extremely low speed range, such as, for example, but without limitation, an idle speed or docking speed. Generally, these speeds will be below a planing speed of the watercraft 10. In an exemplary but non-limiting embodiment, the watercraft speed V can be determined through a calculation based on the engine speed of the engine 12. One exemplary formula that can be used for such calculation can be referred to as a filtered engine speed calculation. For example, a filtered engine speed can be calculated in accordance with the following formula:

$$N_{(n)}=(Nei-N_{(n-1)})\times K+N_{(n-1)}$$

In this above equation, N is a filtered engine rotational speed at time (n) that is indicative of the watercraft speed, Nei is the instantaneous engine speed, and K is a filtering constant for the instantaneous engine speed. In this embodiment, $N_{(n-1)}$ represents a previously calculated filtered engine speed, i.e., at time (n−1). The constant K can be determined by routine experimentation such that the resulting filtered engine speed can be used as to estimate a watercraft or "running" speed. As such, this equation provides a lag in which the filtered engine speed N changes more slowly than the instantaneous engine speed Nei, similar to the way a watercraft speed changes more slowly and its engine speed. Thus the filtered engine speed N is more proportional to the watercraft speed than the instantaneous engine speed Nei.

In some embodiments, the watercraft speed V can be determined using a watercraft speed sensor (not shown). Such well known watercraft speed sensors can include a paddle wheel-type sensor mounted on a lower portion of the hull 14 so as to be in contact with the water in which the watercraft 10 is operating. Of course, any type of watercraft speed sensor can be used.

In the decision block 154, if it is determined that the watercraft speed V is not below a predetermined value, the routine 138 moves on to operation block 152, as described above. If, however, in the decision block 154, it is determined that the watercraft speed V is below a predetermined value, the control routine 138 moves on to an operation block 156.

Figure 7:
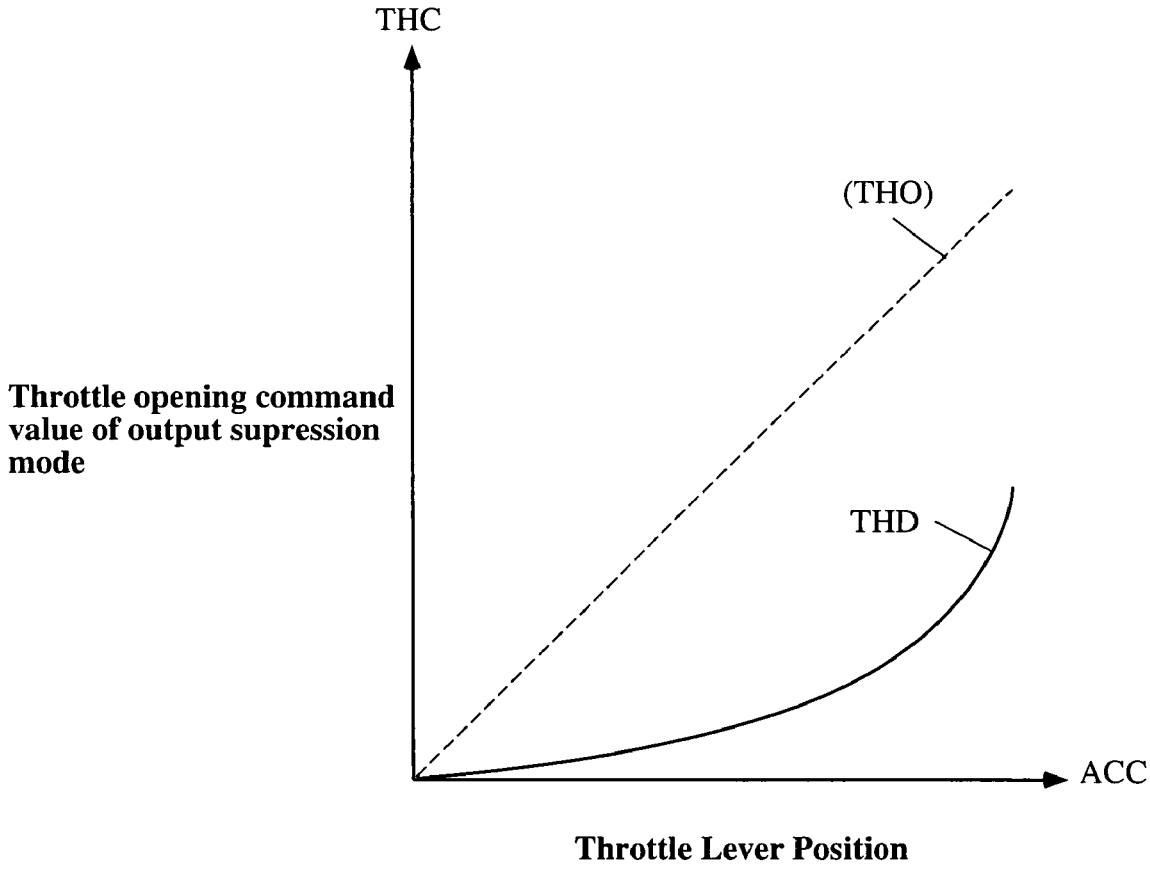
FIG. 7 is a graph illustrating relationships between throttle lever position (horizontal axis) and throttle opening command value (vertical axis) that can be used in conjunction with the control system of FIG. 3.

In the operation block 156, a suppressed output throttle opening value THD is output as the throttle opening command value THC. FIG. 7 illustrates a graphical representation of the relative magnitudes of the output suppressed throttle opening value THD compared to the normal operation throttle position value TH0 (dashed-line). As shown in FIG. 7, the characteristic of the suppressed throttle opening value THD results in a throttle opening command value THC that is less than the values associated with the normal operation characteristic TH0. Additionally, as schematically represented in FIG. 7, the characteristic THD changes much more slowly relative to throttle lever position ACC as compared to the TH0 characteristic.

Thus, for example, when a rider of the watercraft 10 is performing docking maneuvers or operation in a no-wake zone often designated in launching and other areas, substantial movements of the throttle lever results in only small changes in the suppressed output throttle value THD. Thus, small watercraft speed changes can be effected with larger throttle lever movements, thereby allowing the rider of the watercraft 10 to move the throttle lever and thus their finger or hand with larger magnitude movements. As such, the rider can more comfortably adjust speed in the low speed operation range and reduce the occurrence of fatigue in the operator's hand or fingers.

Additionally, as schematically illustrated in FIG. 7, towards the maximum deflected position of the throttle lever, the suppressed output throttle value THD increases more rapidly relative to changes in the throttle lever position. However, the maximum output value THD is about half of the maximum value generated by the TH0 characteristic. Of course, the illustrated characteristic THD is merely one exemplary embodiment. Other characteristics can also be used.

After the operation block 156, the routine 138 moves on to a decision block 158. In the decision block 158, it is again determined if the engine speed is in a low speed operation range. If it is determined that the engine speed is in a low speed operation range, the routine 138 returns to operation block 156 and repeats. However,. if it is determined, in the decision block 158, that the engine speed is not in a low speed operation state, the routine 138 moves on to a decision block 160.

In the decision block 160, it is again determined if the watercraft speed V is not more than a predetermined value. For example, but without limitation, it can be determined whether the watercraft speed V is in an extremely low speed range. This determination can be made in accordance with the description set forth above with regard to the decision block 154. If it is determined, in the decision block 160, that the watercraft speed V is not more than a predetermined value, the routine 138 returns to operation block 156 and repeats. However, if it is determined that the watercraft speed V is more than a predetermined value, the routine moves on to operation block 152. Thus, if the watercraft has been accelerated through sufficient manipulation of the throttle lever 34, the routine 138 allows the watercraft 10 to enter a normal operation mode without manipulation of the selector 120. However, it is to be noted that the operation of the watercraft in the normal operation mode under the control routine 138 will continue only as long as the engine speed remains in an elevated range or the watercraft speed V remains at an elevated speed. If the engine speed and watercraft speed V drop below the predetermined values noted above, the routine 138 again enters the suppressed output operation scenario in which the characteristic THD is used to determine the throttle opening command value THC.

Figure 8:
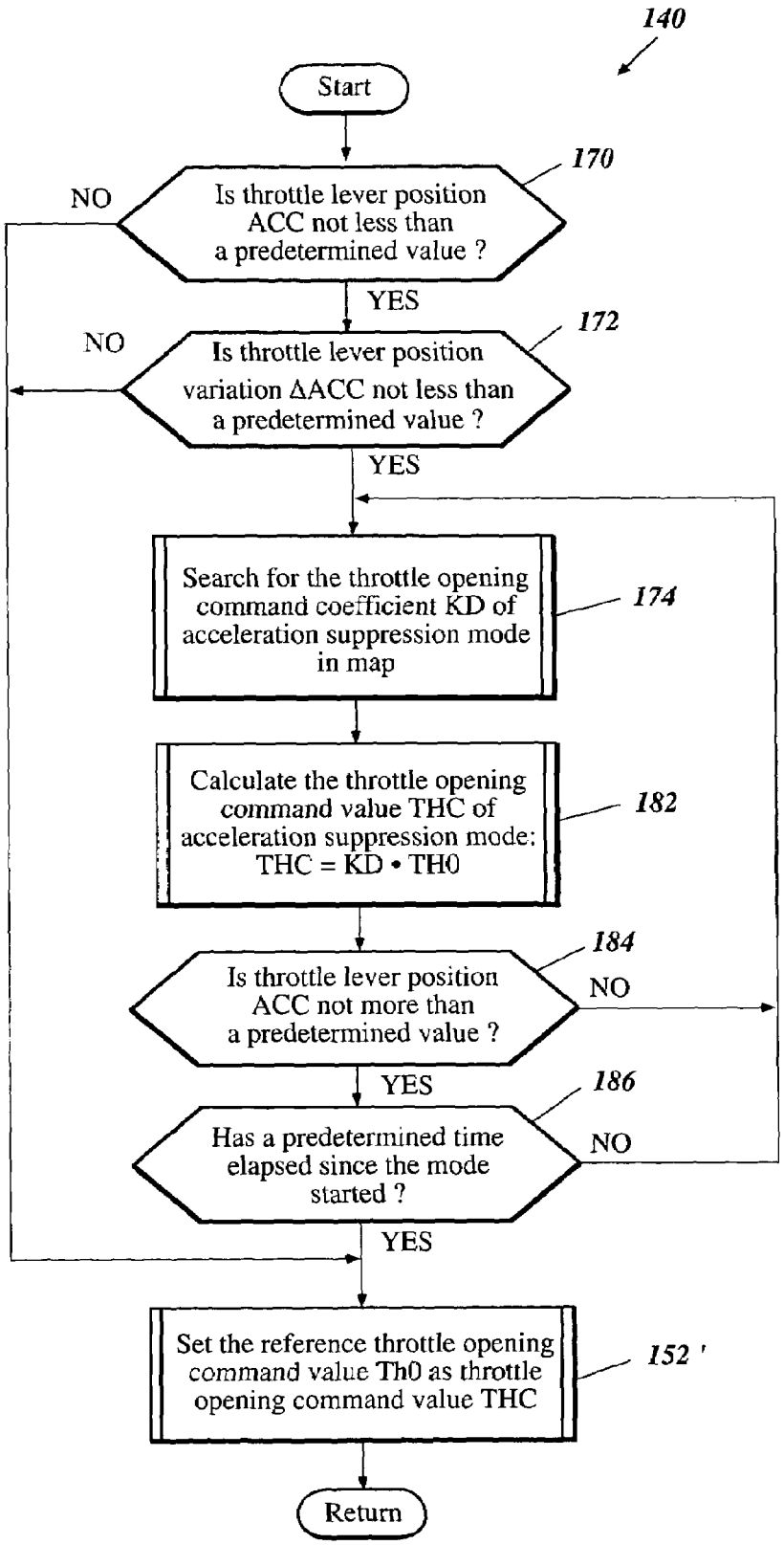
FIG. 8 is a flowchart illustrating a control routine that can be used in conjunction with the control system of FIG. 3.

With reference to FIG. 8, an exemplary embodiment of the control routine 140 is illustrated therein in the form of a flow chart. In this embodiment, the routine 140 begins with a first decision block 170.

In the decision block 170, it is determined whether the throttle lever position is not less than a predetermined value. For example, the ECU 92 can sample the output of the sensor 88 to determine the position of the throttle lever 34. The throttle lever 34 can be considered in a zero or idle state position when the lever 34 is in its biased, relaxed, or released state. If the throttle lever is moved by a rider towards an open position, i.e., squeezed, the position would be considered greater than the idle position. In the decision block 170, if it is determined that the throttle lever position is not less than the predetermined value, the routine 140 moves to operation block 152'. In the routine 140, the operation block 152' can perform the operation noted above with respect to operation block 152 in routine 138. However, if it is determined that the throttle lever position is not less than the predetermined value, the routine 140 moves to a decision block 172.

In the decision block 172, it is determined if the throttle lever position variation ΔACC not less than the predetermined value. If it is determined that the throttle lever position variation ΔACC is less than the predetermined value, the routine 140 moves to the operation block 152' and returns. However, if it is determined that the throttle lever position variation ΔACC is not less than the predetermined value, it is determined that the rider is requesting an elevated rate of acceleration of the watercraft 10. Thus, the routine 140 moves on to operation block 174.

Figure 9:
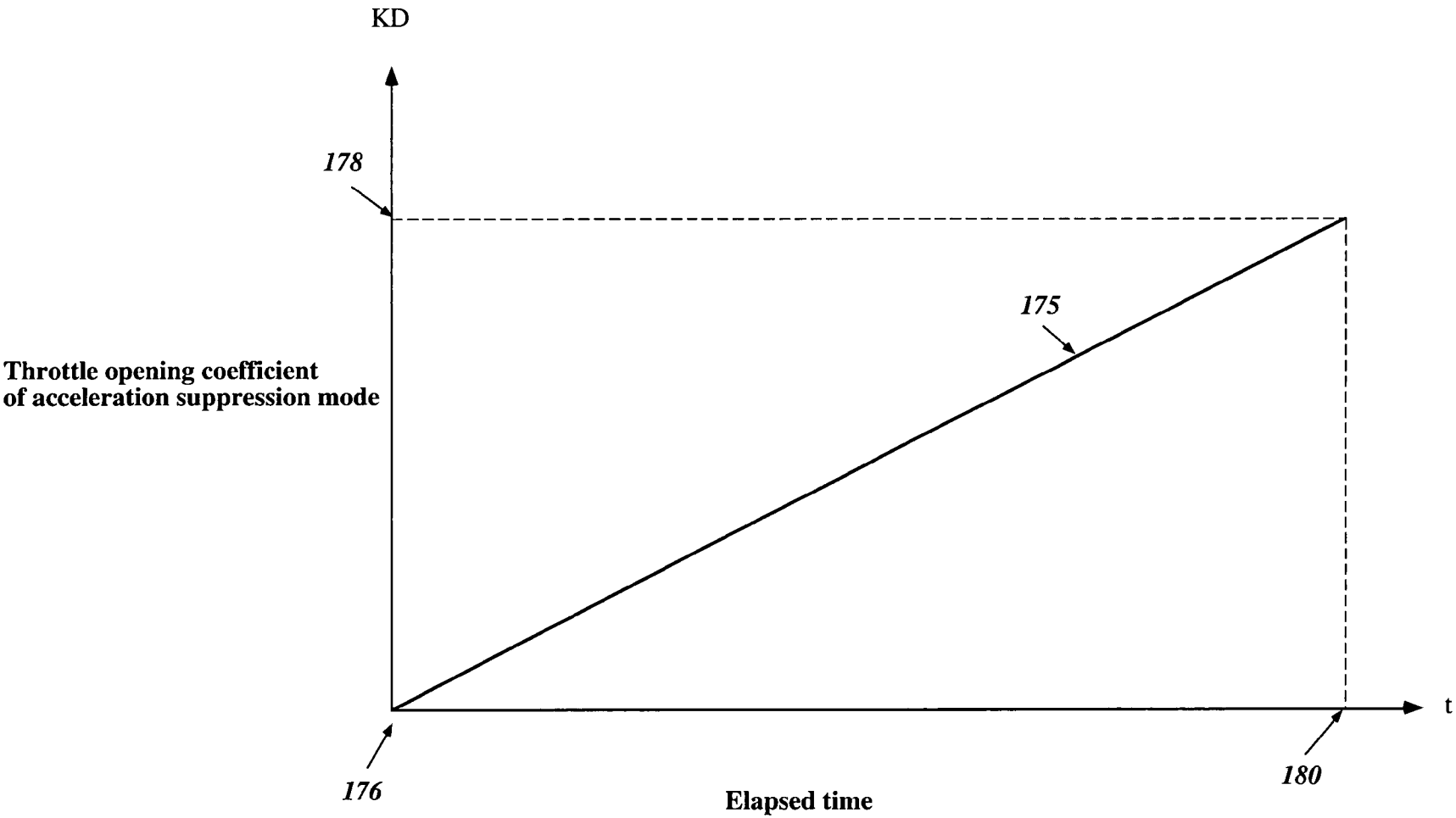
FIG. 9 is a graph illustrating a relationship between elapsed time (horizontal axis) and throttle opening coefficient (vertical axis) that can be used in conjunction with the control system of FIG. 3.

In the operation block 174, a throttle opening coefficient KD is determined. For example, with reference to FIG. 9, an exemplary characteristic 175 is illustrated for determining the coefficient KD. The horizontal axis of FIG. 9 represents elapsed time from the beginning of the acceleration suppression mode. In this context, the beginning of the acceleration suppression mode starts when the routine 140 reaches the operation block 174. Or in other words, after it is determined that the absolute position of the throttle lever is greater than a predetermined value and the speed of movement of the throttle lever 34 is above a predetermined speed. In this situation, the rider is requesting an elevated rate of acceleration of the watercraft 10. Thus, in the acceleration suppression mode, the acceleration coefficient KD begins at a minimum value identified by the reference numeral 176 and reaches a maximum value identified by the reference numeral 178.

In some embodiments, the initial value of the coefficient KD can be 0 at value 176 and 1 at value 178. Additionally, as illustrated by the characteristic 175, the value KD rises from the minimum point 176 to the maximum point 178 over a period of time identified by the reference numeral 180. The total magnitude of the amount of time over which the characteristic 175 rises from the minimum value 176 to the maximum value 178 can be determined by one of ordinary skill in the art in light of the watercraft or vehicle in which such a system is used. In an exemplary but non-limiting embodiment, the amount of time identified by reference numeral 180 can be about 2 seconds. After the coefficient KD is determined in operation block 174, the routine 140 moves to operation block 182.

In the operation block 182, the throttle opening command value THC is calculated based on the coefficient KD and the throttle opening value TH0,(i.e., KD×TH0). The value TH0, for example, can be determined from the characteristic TH0 identified in FIG. 5, which also can be used in the normal mode operation. The value THC determined in operation block 182 is output as the throttle opening command value THC. Thus, the throttle valve 90 is manipulated to correspond to the throttle opening command value THC. After the operation block 182, the routine 140 moves to decision block 184.

In the decision block 184, it is determined if the throttle lever position ACC is not more than a predetermined value. For example, the throttle lever position ACC at decision block 184 can be compared to the same predetermined value used in decision block 170, or another predetermined value. If the throttle lever position ACC at decision block 184 is not more than the predetermined value, the rider has released or relaxed their grip on the throttle lever 34. However, if the rider has not released their grip on the throttle lever 34, then the throttle lever position ACC will remain above the predetermined value. If it is determined in the decision block 184 that the throttle lever position ACC is more than the predetermined value, the routine 140 returns to operation block 174 and repeats. However, if it is determined in the decision block 184 that the throttle lever position ACC is not more than the predetermined value, the routine moves on to operation block 186.

In the decision block 186, it is determined whether the predetermined time has elapsed since the acceleration suppression mode has started. For example, as noted above, the beginning of the acceleration suppression mode begins after the results of both decision blocks 170 and 172 are positive. Additionally, as noted above, FIG. 9 illustrates the predetermined time as 180. If it is determined in the decision block 186 that the predetermined time has not elapsed, the routine 140 returns to operation block 174 and repeats. However, if it is determined in decision block 186 that the predetermined time has elapsed, the routine 140 moves to operation block 152' and repeats.

Figure 10:
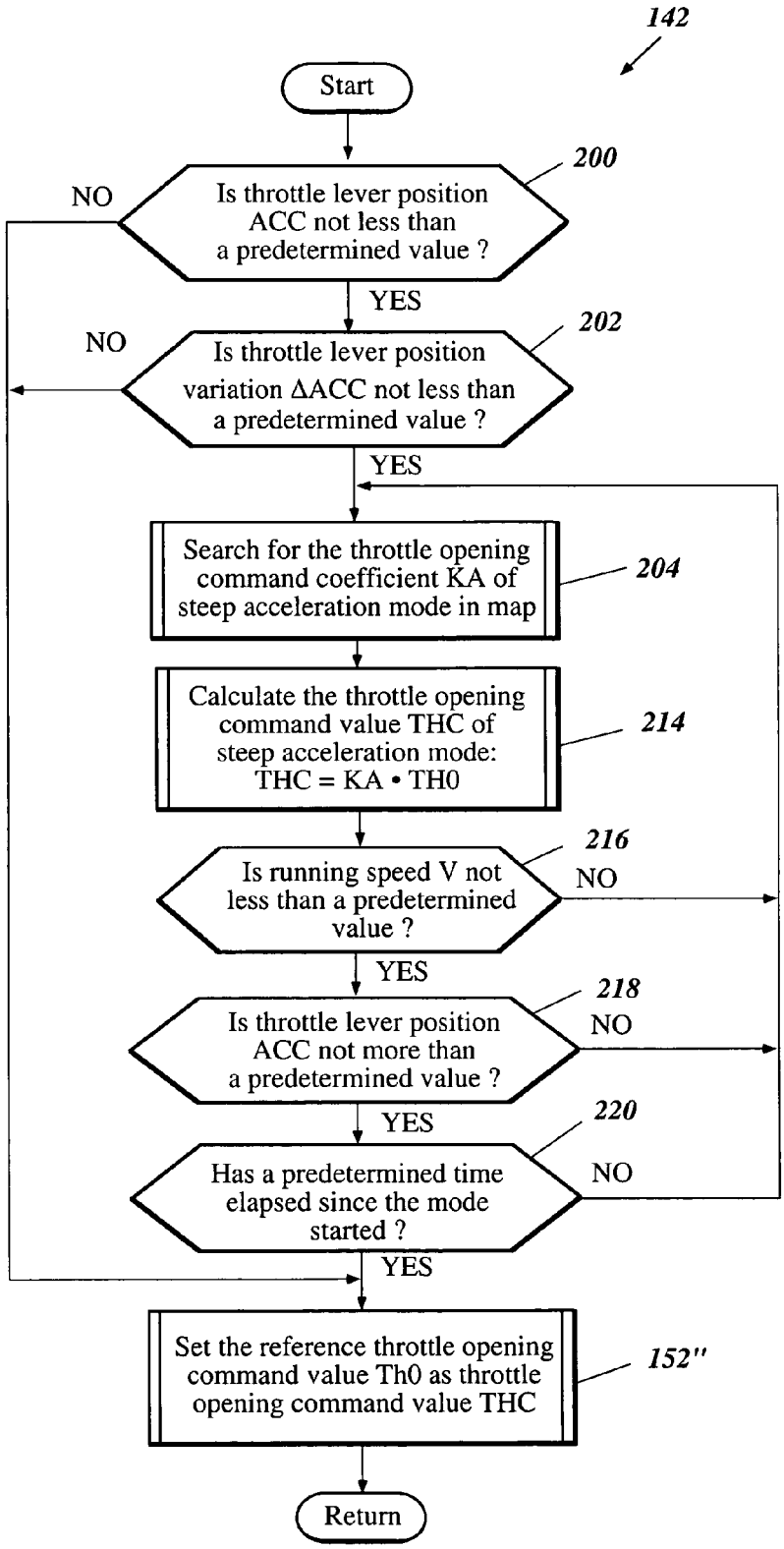
FIG. 10 is a flowchart illustrating a control routine that can be used in conjunction with the control system of FIG. 3.

With reference to FIG. 10, the control routine 142 is schematically illustrated therein in the form of a flow chart. The routine 142 begins with a decision block 200.

In the decision block 200, it is determined if the throttle lever position ACC is not less than a predetermined value. For example, the determination of decision block 200 can be performed in accordance with the decision block 170 of the routine 140. If it is determined that the throttle lever position ACC is less than the predetermined value, the routine 142 moves to operation block 152". The operation block 152" can be the same as the operation block 152' of routine 140 and operation block 152 of routine 138. However, if it is determined that the throttle lever position ACC is not less than the predetermined value, the routine 142 moves to the decision block 202.

In the decision block 202, it is determined if the throttle lever position variation ΔACC is not less than a predetermined value. For example, the determination performed in decision block 202 can be the same as the operation in decision block 172 of routine 140. If it is determined that the throttle lever position variation ΔACC is less than the predetermined value, the routine 142 moves to the operation block 152" and repeats. However, if it is determined in the decision block 202 that the throttle lever position variation ΔACC is not less than a predetermined value, the routine 142 moves to operation block 204.

In the operation block 204, an enhanced acceleration throttle opening coefficient KA is determined. For example, with reference to FIG. 11, the characteristic identified by the reference numeral 206 represents a value of the enhanced acceleration coefficient KA over a period of time. The enhanced acceleration coefficient KA begins with an initial value identified by the reference numeral 208 and changes over time until it reaches a minimum value identified by the reference numeral 210. The time period over which the coefficient KA changes from the initial value 208 to the end value 210 is identified by the reference numeral 212. The time period represented by the reference numeral 212 can be set at any value. In an exemplary but non-limiting embodiment, the time period 212 can be about 2 seconds.

Figure 11:
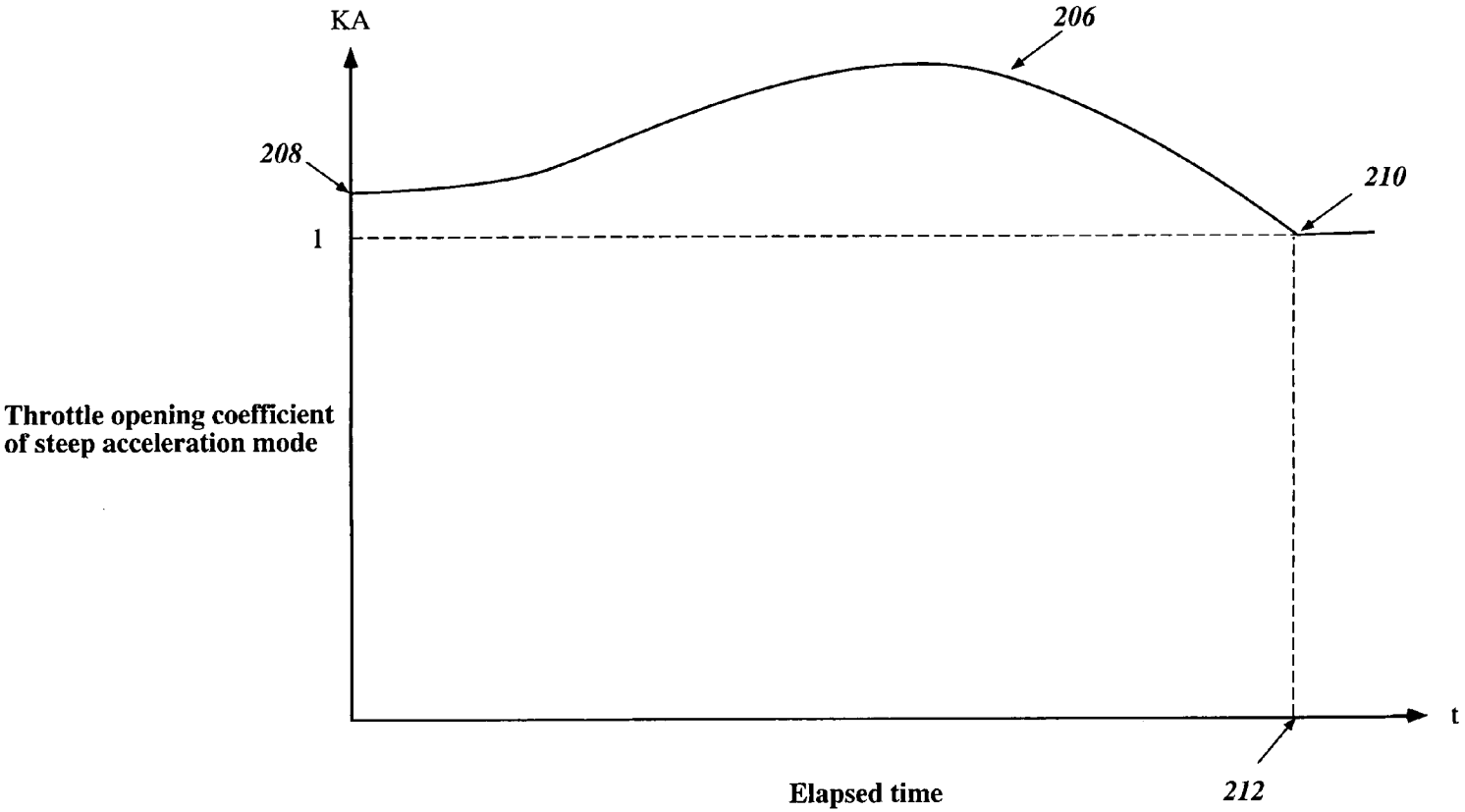
FIG. 11 is a graph illustrating the relationship between elapsed time (horizontal axis) and a throttle opening coefficient (vertical axis).

Additionally, in an exemplary but non-limiting embodiment, the initial value 208 can be a value greater than 1 and the final value 210 can be a value of 1. As illustrated in FIG. 11, the variation of the coefficient KA can vary in a non-linear manner from the value 208 to the value 210. The value of the coefficient KA can be used as a multiplier to increase the throttle opening and thus provide an enhanced acceleration mode for the operator.

When the routine 142 initially reaches the operation block 204, the value of the coefficient KA is the initial value 208. After the operation block 204, the routine 142 moves to an operation block 214.

In the operation block 214, the throttle opening command value THC is determined by multiplying the enhanced acceleration coefficient KA and the throttle opening value TH0. The throttle opening value TH0 can be derived from the characteristic TH0 represented in FIG. 5. In the operation block 214, the throttle opening command value THC is outputted for use in controlling the position of a throttle valve 90. After the operation block 214, the routine 142 moves to a decision block 216.

In the decision block 216, it is determined if a watercraft speed V is not less than a predetermined value. For example, as noted above, with reference to operation block 154 of routine 138, a watercraft speed V can be determined through a calculation involving the engine speed of the engine 12 or a direct measurement of watercraft speed with a watercraft speed sensor. If it is determined that the watercraft speed V is less than a predetermined value, the routine 142 returns to operation block 204 and repeats. However, if it is determined in the decision block 216 that the watercraft speed V is not less than a predetermined value, the routine 142 moves on to decision block 218.

In the decision block 218, it is determined if the throttle lever position ACC is not greater than a predetermined value. If it is determined that the throttle lever position ACC is more than the predetermined value, the routine 142 returns to operation block 204 and repeats. However, if it is determined in decision block 218 that the throttle lever position ACC is not more than the predetermined value, the routine 142 moves to decision block 220.

In the decision block 220, it is determined if a predetermined time has elapsed since the enhanced acceleration mode began. For example, with reference to FIG. 11, it can be determined if the elapsed time since the routine 142 first reached the operation block 204 is equal to or greater than the time represented by reference numeral 212 in FIG. 11. If it is determined that the elapsed time has not exceeded the predetermined time, the routine 142 returns to operation block 204 and repeats. However, if in the decision block 220, it is determined that the predetermined time has elapsed, the routine 142 moves to operation block 152" and repeats.

Figure 12:
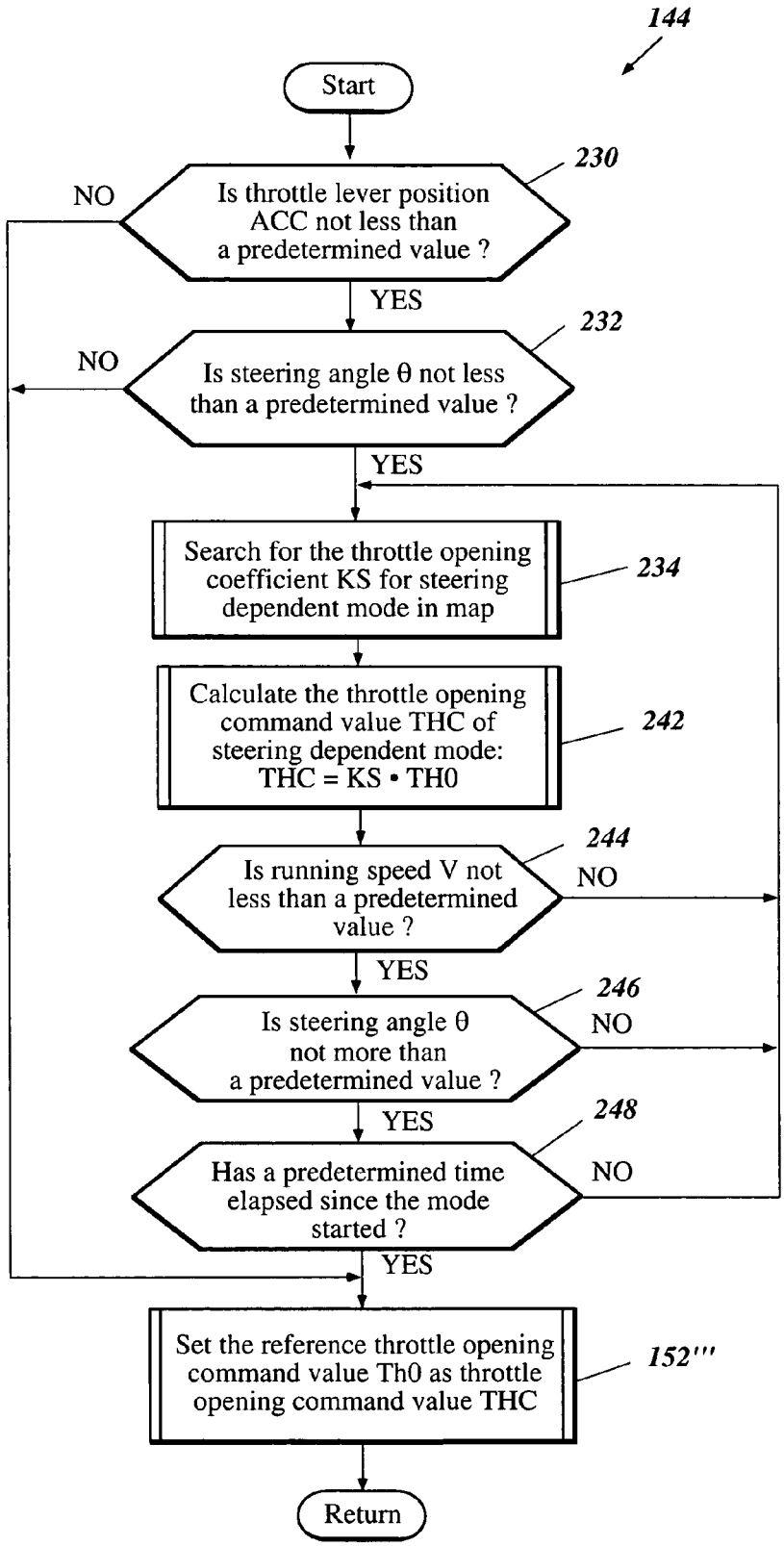
FIG. 12 is a flowchart illustrating a control routine that can be used in conjunction with the control system of FIG. 3.

FIG. 12 schematically illustrates the control routine 144 as a flow chart. As shown in FIG. 12, the routine 144 begins at a decision block 230.

In the decision block 230, it is determined whether the throttle lever position ACC is not less than a predetermined value. If, in the decision block 230, it is determined that the throttle lever position ACC is less than a predetermined value, the routine 144 moves to operation block 152'" and returns. The operation block 152'" can perform the operation identified and described above with reference to operation blocks 152", 152', and 152.

However, if it is determined in the decision block 230 that the throttle lever position is not less than a predetermined value, the routine 144 moves to decision block 132.

In the decision block 132, it is determined whether a steering angle θ is not less than a predetermined value. If it is determined that the steering angle θ is less than a predetermined value, the routine 144 moves to operation block 152'" and repeats. However, if it is determined that the steering angle θ is not less than a predetermined value, the routine 144 moves to operation block 234.

Figure 13:
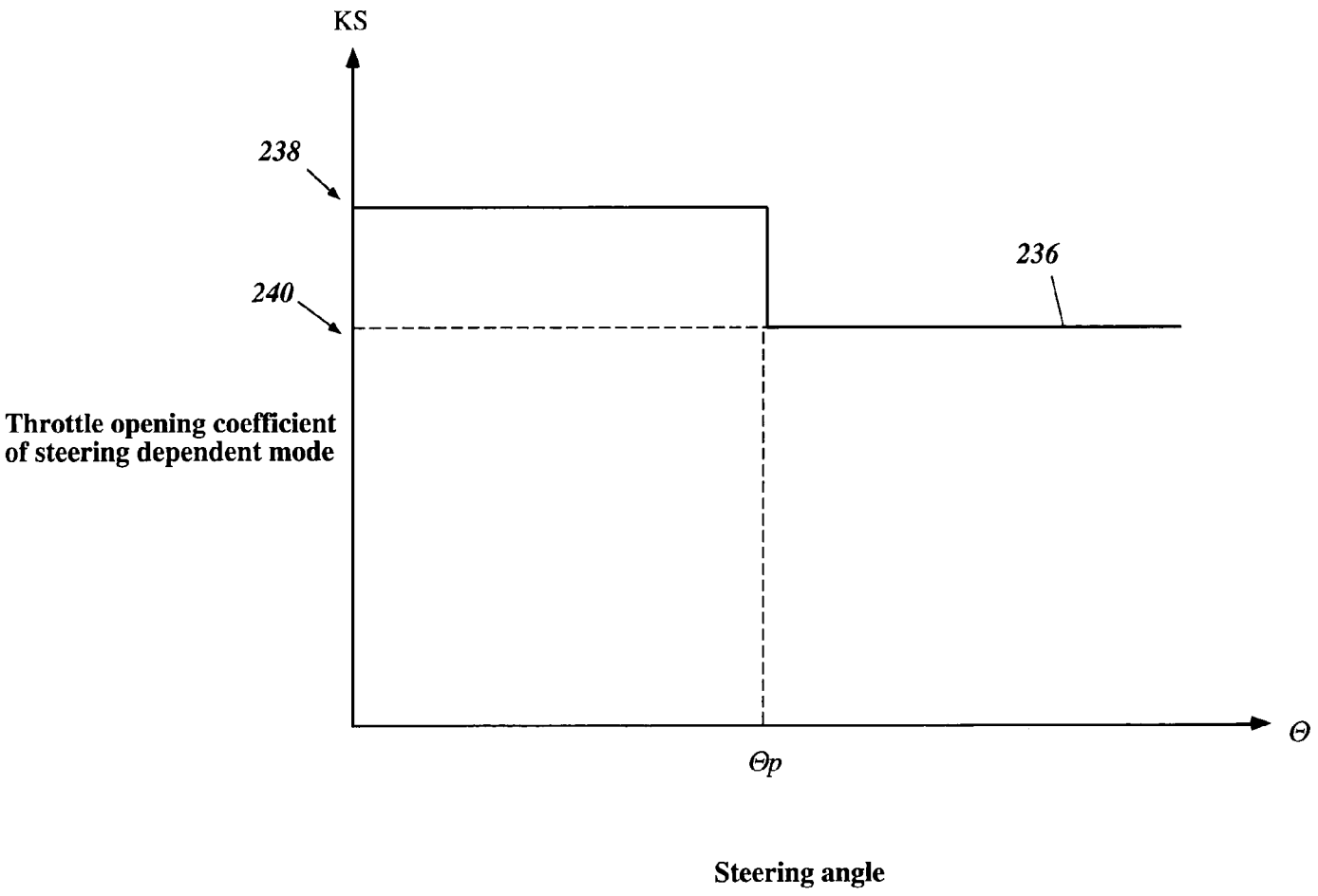
FIG. 13 is a graph illustrating the relationship between steering angle (horizontal axis) and throttle opening coefficient (vertical axis) that can be used in conjunction with the control system of FIG. 3.

In operation block 234, a throttle opening coefficient for steering mode operation KS is determined. For example, the coefficient KS can be determined with reference to a characteristic 236 illustrated in FIG. 13. As shown in FIG. 13, the characteristic 236 results in a coefficient KS of an initial value identified by the reference numeral 238 and falls to a reduced value identified by the reference numeral 240 when the steering angle θ is above the predetermined steering angle $\theta_P$. In an exemplary but non-limiting embodiment, the initial value 238 can be equal to 1 and the reduced value 240 can be a value that is less than 1. Preferably, the reduced value 240 will generate a reduced power output of the engine so as to enhance engine operation during turning, described in greater detail below.

After the operation block 224, the routine 144 moves to operation block 242. In the operation block 242, the throttle opening command value THC is based on the throttle opening coefficient for steering mode KS and the throttle lever opening value TH0. For example, in the operation block 242, the throttle opening command value THC can be calculated by multiplying the throttle opening coefficient for steering KS and the throttle opening value TH0 determined by the characteristic TH0 illustrated in FIG. 5. Thus, when the handlebars 32 are not turned beyond the predetermined steering angle $\theta_P$, the value of the throttle opening command value THC is equal to the throttle opening value TH0. However, when the handlebars 32 are turned beyond the predetermined steering angle $\theta_P$, the throttle opening command value THC calculated in operation block 242 will be the throttle opening value TH0 multiplied by the reduced value 240.

As noted above, preferably, the reduced value 240 of the coefficient KS will produce a reduction in the power output of the engine 12 so as to enhance steering. For example, where the throttle lever is held at an enlarged opening and the handlebars 32 are turned beyond the predetermined steering angle $\theta_P$, air can be drawn into the jet pump causing cavitation as well as other effects. Thus, by setting the reduced value 240 at an appropriate value, the power output of the engine 12 can be reduced so as to prevent cavitation and thereby improve the comfort of the rider during turning. In the operation block 242, the throttle opening command value THC calculated therein is output for controlling the position of the throttle valve 90. After the operation block 242, the routine 144 moves to a decision block 244.

In the decision block 244, it is determined whether the watercraft speed V is not less than a predetermined value. If it is determined that the watercraft speed V is less than the predetermined value, the routine returns to operation block 234 and repeats. However, if it is determined, in the decision block 244, that the watercraft speed V is not less than a predetermined value, the routine 144 moves to a decision block 246.

In the decision block 246, it is determined whether the steering angle θ is not more than the predetermined steering angle $\theta_P$. If the steering angle θ is less than the predetermined steering angle $\theta_P$, the routine 144 returns to the operation block 234 and repeats. However, if it is determined, in the decision block 246, that the steering angle θ is not more than the predetermined steering angle $\theta_P$, the routine moves to a decision block 248.

In the decision block 248, it is determined if a predetermined time has elapsed since the routine 144 reached the operation block 234. If it is determined that the predetermined time has not elapsed, the routine 144 returns to the operation block 234 and repeats. However, if it is determined, in the decision block 248, that the predetermined time has elapsed, the routine moves on to operation block 152''' and returns. The predetermined time period can be any predetermined time. Preferably, the predetermined amount of time is set at an amount of time that will aid in making turning more comfortable for the rider of the watercraft.

Figure 14:
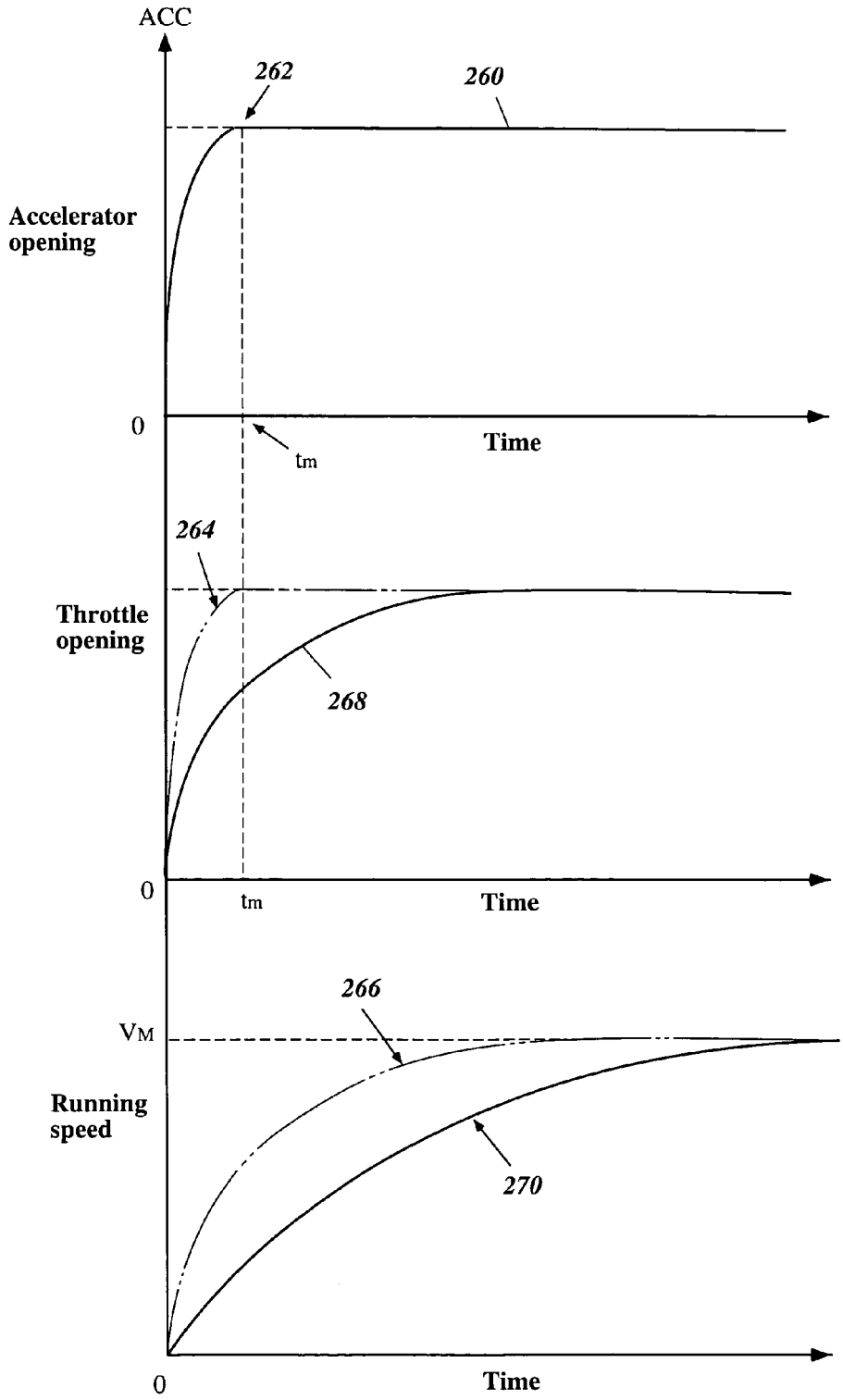
FIG. 14 is a timing diagram illustrating an exemplary but non-limiting operation of the control system of FIG. 3, including a first graph illustrating a throttle lever position change over time, a second graph illustrating the movement of the throttle valve over time, and a third graph representing engine speed over time.

FIG. 14 illustrates the timing diagrams, schematically representing a relationship between the movement of the throttle lever 34, the movement of the throttle valve 90, and the watercraft speed V resulting therefrom. At the top of FIG. 14, a first characteristic identified by the reference numeral 260 (solid line) illustrates the position ACC of the throttle lever 34 over time. As shown in this portion of the timing diagram of FIG. 14, the throttle lever 34 is moved from a 0 position (corresponding to an idle speed position) to a maximum position 262 at a time $t_m$. When the watercraft 10 is operating in the normal mode, the throttle valve 90 is moved in accordance with the characteristic TH0 illustrated in FIG. 5. Thus, as shown in the throttle opening portion of the timing diagram of FIG. 14, the actual throttle valve position in the normal mode is illustrated by characteristic 264 (phantom line).

In the watercraft speed or "running speed" portion of the timing diagram of FIG. 14, the watercraft speed V of the watercraft 10 in response to the throttle valve movement illustrated by the characteristic 264, is identified by the characteristic 255 (phantom line). As shown in the running speed portion of the timing diagram of FIG. 14, and represented by the characteristic 266, the watercraft speed V gradually rises to a maximum watercraft speed $V_M$.

FIG. 14 also illustrates, in solid line, the movement of the throttle valve and the watercraft speed V during acceleration suppression mode operation. For example, in the throttle opening portion of the timing diagram of FIG. 14, the characteristic 268 represents the movement of the throttle valve under acceleration suppression mode operation when the throttle lever is moved in accordance with the characteristic 260.

As shown in FIG. 14, the throttle valve 90, the opening of which is represented by the characteristic 268, opens more slowly in response to the movement of the throttle lever 34. This results in a more gradual watercraft speed V acceleration, represented by the characteristic 270 (solid line). As noted above, with reference to FIG. 9, the delayed response of the throttle valve 90 to the throttle lever movement is generated by the use of the coefficient KD, as used in the exemplary flow chart illustrating the routine 140 of FIG. 8. As a result, the watercraft speed V of the watercraft 10 rises more gently and thus prevents the faster acceleration that would have resulted in the normal mode.

Figure 15:
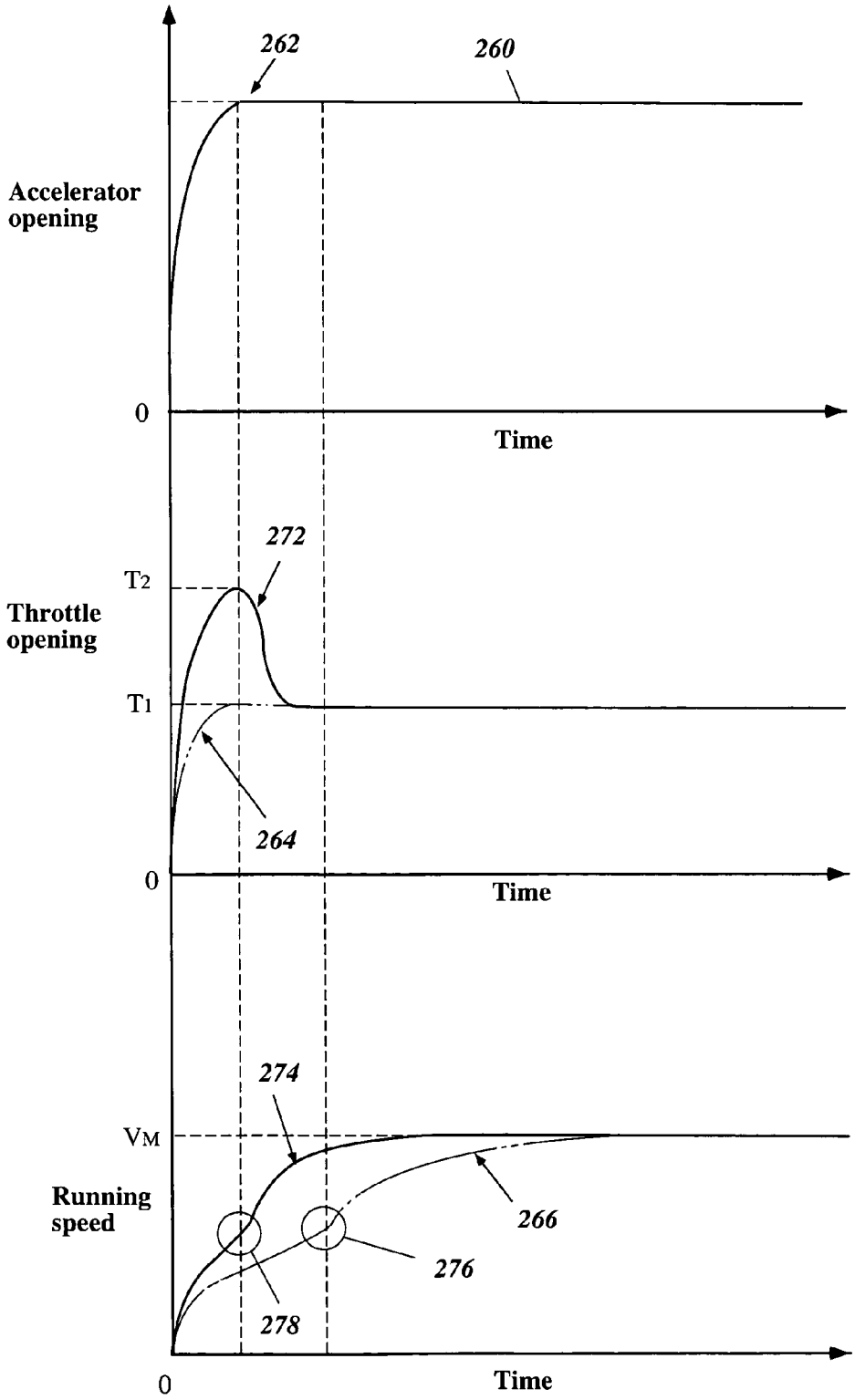
FIG. 15 includes a timing diagram illustrating an exemplary but non-limiting operation of the control system of FIG. 3, including the first graph showing a throttle lever position movement over time, a second graph illustrating throttle valve movement over time, and a third graph illustrating engine speed over time.

FIG. 15 schematically illustrates a timing diagram which reflects the performance of the watercraft 10 during the enhanced acceleration mode. As shown in the upper portion of the timing diagram therein, the accelerator lever is moved quickly from a 0 or idle position to a maximum position identified by the reference numeral 262.

As shown in the middle portion of the timing diagram, the throttle opening, represented by the characteristic 264, follows the movement of the throttle lever. Finally, the lower portion of the timing diagram illustrates the watercraft speed as characteristic 266.

In the enhanced acceleration mode, as noted above with respect to operation blocks 204, 214, as well as the characteristic 206 shown in FIG. 11, the throttle valve 90 is moved more quickly in this mode than in a normal mode. For example, the characteristic 272 (solid line) illustrates the movement of the throttle valve 90 during enhanced acceleration mode operation. This enhanced acceleration mode results in a faster watercraft acceleration, as illustrated by the characteristic 274 of the lower portion of FIG. 15. As illustrated in this timing diagram, the watercraft speed V reaches the maximum watercraft speed $V_M$ sooner than under the normal operation mode.

Additionally, as illustrated by the characteristics 266 and 274, there is a fluctuation in the watercraft speed V during acceleration. For example, during normal mode operation, a fluctuation (identified by the reference numeral 276) is generated by the transition of the watercraft 10 from a displacement mode of operation to a planing mode of operation. Similarly, under the enhanced acceleration mode operation, there is a watercraft speed fluctuation identified by the reference numeral 278. As reflected in the timing diagram of FIG. 15, the transition to planing speed occurs more rapidly in the enhanced mode operation.

Additionally, with respect to the throttle opening portion of the timing chart of FIG. 15, it is to be noted that the throttle valve 90 achieves a greater opening value during the enhanced mode operation. The throttle valve 90 can be configured to allow for this operation in any number of ways. For example, the throttle valve can be configured to open to a position $T_1$ as the maximum position for normal mode operation. As an exemplary but non-limiting embodiment, the throttle valve opening $T_1$ can correspond to an angular position of the throttle valve 90 that is less than 90 degrees, thereby placing the throttle valve 90 in a position in which the air flowing into the intake port 78 is partially restricted. In this manner, the fully opened position of the throttle valve can occur at the position $T_2$, and thus only be achieved during the enhanced acceleration mode operation. Of course, other types of systems can be used to achieve this effect.

Figure 16:
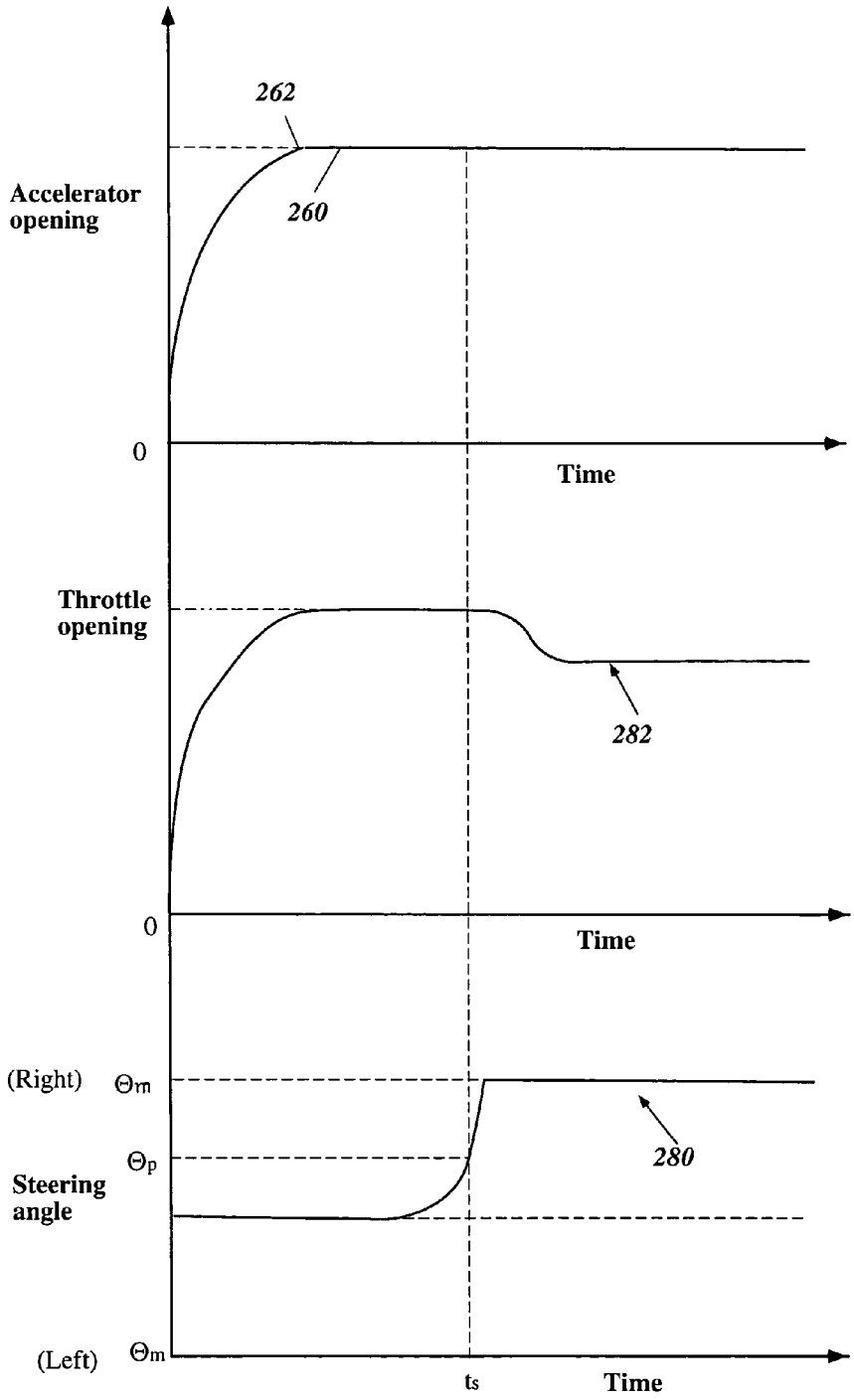
FIG. 16 is a timing diagram illustrating a non-limiting operation of the control system of FIG. 3, including the first graph showing a throttle lever movement over time, a second graph illustrating a throttle valve position change over time, and a third graph illustrating a steering angle change over time.

FIG. 16 includes a timing diagram schematically illustrating the performance of the watercraft 10 during a steering dependent mode operation. The upper portion of the timing diagram illustrates the movement of the throttle lever 34 and is identified by the characteristic 260.

The lower portion of the timing diagram of FIG. 16 illustrates the steering angle of the handlebars 32 represented by the characteristic 280. As shown in FIG. 16, and represented by the characteristic 280, at time $t_s$, the handlebar 32 is turned beyond the predetermined steering angle $\theta_P$. As noted above with reference to the flow chart of FIG. 12, when the steering angle $\theta$ is greater than the predetermined steering angle $\theta_P$, the throttle opening command THC is reduced in accordance with the characteristic of FIG. 13. This results in the characteristic identified by the reference numeral 282. For example, in the characteristic 282, after the time $t_s$, the throttle opening is reduced. As such, this reduces the power output of the engine and can help prevent cavitation and improve the comfort of the rider during turning.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions can be replaced by other indicators of the same or similar operating conditions. Moreover, not all of the features, aspects and advantages are necessarily required to practice the present invention. Accordingly, the scope of the of at least some of the inventions disclosed herein is intended to be defined only by the claims that follow.

What is claimed is:

1. A watercraft comprising a hull, an engine supported by the hull, a propulsion device supported by the hull and driven by the engine so as to propel the watercraft, a power output control module configured to control a power output of the engine in at least three different modes of operation, the at least three modes of operation including at least three of a normal operation mode, a reduced output mode, an enhanced acceleration mode, a suppressed acceleration mode, and a steering dependent mode, and a mode selector configured to be operable by an operator of the watercraft so as to allow the operator to select one of the least three modes of operation, the watercraft further comprising an induction system configured to guide air to the engine and a valve configured to meter an amount of air flowing through the induction system into the engine, the valve being controlled by the power output control module so as to move the valve according to at least one of three predetermined relationships with a power request from the operator of the watercraft, the at least one of three predetermined relationships corresponding respectively to the at least three modes of operation.

2. The watercraft according to claim 1 additionally comprising a steering device configured to be manipulable by an operator of the watercraft, the steering device including a power output request device configured to allow an operator to request power output from the engine.

3. The watercraft according to claim 1, wherein the mode selector is disposed on the watercraft in a position such that an operator of the watercraft can manipulate the selector during operation of the watercraft.

4. The watercraft according to claim 1 wherein the power output control module is configured to operate in each of the reduced output mode, enhanced acceleration mode, suppressed acceleration mode, and steering dependent mode.

5. A watercraft comprising a hull, an engine supported by the hull, a propulsion device supported by the hull and driven by the engine so as to propel the watercraft, a power output control module configured to control a power output of the engine in at least three different modes of operation, the at least three modes of operation including at least three of a normal operation mode, a reduced output mode, an enhanced acceleration mode, a suppressed acceleration mode, and a steering dependent mode, and a mode selector configured to be operable by an operator of the watercraft so as to allow the operator to select one of the least three modes of operation, wherein the power output control module is configured to increase the power output from the engine to a lesser degree in response to a power output request of a first magnitude when in the output suppression mode as compared to an increase in power output from the engine in response to the power output requests of the first magnitude when in the normal operation mode.

6. The watercraft according to claim 5, wherein the power output control module is configured to increase the power output from the engine at a first rate for a low range of power output requests and increase the power output from the engine at a second rate, higher than the first rate, for high range power output requests.

7. A watercraft comprising a hull, an engine supported by the hull, a propulsion device supported by the hull and driven by the engine so as to propel the watercraft, a power output control module configured to control a power output of the engine in at least three different modes of operation, the at least three modes of operation including at least three of a normal operation mode, a reduced output mode, an enhanced acceleration mode, a suppressed acceleration mode, and a steering dependent mode, and a mode selector configured to be operable by an operator of the watercraft so as to allow the operator to select one of the least three modes of operation, wherein the power output control module is configured to increase a power output from the engine at a first rate for a power output request of the first magnitude when in the enhanced acceleration mode and to increase a power output from the engine at a second rate for a power output request of the first magnitude when in the normal mode, wherein the first rate is greater than the second rate.

8. A watercraft comprising a hull, an engine supported by the hull, a propulsion device supported by the hull and driven by the engine so as to propel the watercraft, a power output control module configured to control a power output of the engine in at least three different modes of operation, the at least three modes of operation including at least three of a normal operation mode, a reduced output mode, an enhanced acceleration mode, a suppressed acceleration mode, and a steering dependent mode, and a mode selector configured to be operable by an operator of the watercraft so as to allow the operator to select one of the least three modes of operation, wherein the power output control module is configured to cause the engine to the output a first magnitude of the power in response to a power output request of a first magnitude when operating normal mode, the power output control module being configured to cause the engine to output a second magnitude of power in response to an engine output request of the first magnitude when in the steering dependent mode, the first magnitude of power being greater than the second magnitude of power, only when the watercraft is being steered in a direction and other than straight ahead.

9. A method of controlling an engine of the watercraft having an engine driving a propulsion device, a throttle valve configured to meter an amount of air flowing into the engine, and a power output request device configured to be operable by a rider of the watercraft, the method comprising changing the opening of the throttle valve in accordance with a first relationship with a state of the power output request device under a first mode of operation, changing the opening of the throttle valve in accordance with a second relationship with a state of the power output request device under a second mode of operation, and changing the opening of the throttle valve in accordance with a third relationship with a state of the power output request device under a third mode of operation, wherein the first, second, and third modes of operation correspond respectively to at least one of a normal mode, and output suppression mode, and acceleration suppression mode, and enhanced acceleration mode, and a steering dependent mode.

10. The method according to claim 9, wherein the first mode of operation is the normal mode of operation and wherein the second mode of operation is the output suppression mode, wherein changing the opening of the throttle valve in accordance with a first relationship comprises opening the throttle valve to a first degree of opening when the power output request device is in a first state, and wherein changing the opening of the throttle valve in accordance with a second relationship comprises opening the throttle valve to a second degree of opening when the power output request device is in a first state, wherein the second degree comprises a smaller magnitude throttle valve opening than the first degree.

11. The method according to claim 10, wherein changing the opening of the throttle valve in accordance with a second relationship further comprises opening the throttle valve at a first rate in accordance with changes in the state of the power output request device at a lower range of operation and opening the throttle valve at a second rate that is greater than the first rate in accordance with changes in the state of the power output request device at a higher range of operation.

12. The method according to claim 9, wherein the first mode of operation is the normal mode into the second mode of operation is the acceleration suppression mode, wherein changing the opening of the throttle valve in accordance with a first relationship comprises moving the throttle valve between first and second positions at a first rate when the power output request device is moved from a first state to a second state, and wherein changing the opening of the throttle valve in accordance with a second relationship comprises moving the throttle valve between the first and second positions at a second rate that is less than the first rate when the power output request device is moved from the first state to the second state.

13. The method according to claim 9, wherein the first mode of operation is the normal mode and the second mode of operation is the enhanced acceleration mode, wherein changing the opening of the throttle valve in accordance with a first relationship comprises moving the throttle valve between first and second positions at a first rate when the power output request device is moved from a first state to a second state, and wherein changing the opening of the throttle valve in accordance with a second relationship comprises moving the throttle valve between the first and second positions a second rate that is greater than the first rate when the power output request device is moved from the first state to the second state.

14. The method according to claim 9, wherein the first mode of operation is the normal mode and the second mode of operation is the steering dependent mode, wherein changing the opening of the throttle valve in accordance with the second relationship comprises moving the throttle valve in response to a movement of a steering mechanism of the watercraft when a state of the power output request device has not changed.

* * * * *

UNITED STATES PATENT AND TRADEMARK OFFICE

CERTIFICATE OF CORRECTION

PATENT NO. : 7,166,003 B2
APPLICATION NO. : 10/872013
DATED : January 23, 2007
INVENTOR(S) : Hitoshi Motose It is certified that error appears in the above-identified patent and that said Letters Patent is hereby corrected as shown below:

In column 1, line 11 (Approx.) delete “INFORMATIONS” and insert -- INVENTIONS --, therefor.

In column 3, line 21 (Approx.) delete “EMBODIMENTS” and insert -- EMBODIMENT --, therefor.

In column 6, line 30 (Approx.) delete “chambers,68” and insert -- chambers 68 --, therefor.

In column 12, line 64 delete “However,.” and insert -- However, --, therefor.

Signed and Sealed this

Twenty-fourth Day of February, 2009

John Doll

JOHN DOLL
*Acting Director of the United States Patent and Trademark Office*